US009465350B2

(12) United States Patent
Jang et al.

(10) Patent No.: US 9,465,350 B2
(45) Date of Patent: Oct. 11, 2016

(54) TONER CARTRIDGE AND ELECTROPHOTOGRAPHIC IMAGE FORMING APPARATUS USING THE SAME

(71) Applicant: Samsung Electronics Co., Ltd., Suwon-si, Gyeonggi-do (KR)

(72) Inventors: Ho-jin Jang, Suwon-si (KR); Dong-geun Lee, Suwon-si (KR); Byeong-no Jeong, Suwon-si (KR); Ji-won Moon, Suwon-si (KR); Seung-chan Park, Hwaseong-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/658,866

(22) Filed: Mar. 16, 2015

(65) Prior Publication Data

US 2015/0355595 A1 Dec. 10, 2015

(30) Foreign Application Priority Data

Jun. 10, 2014 (KR) ..... 10-2014-0069958

(51) Int. Cl.
*G03G 21/10* (2006.01)
*G03G 21/12* (2006.01)

(52) U.S. Cl.
CPC ..... *G03G 21/105* (2013.01); *G03G 21/12* (2013.01)

(58) Field of Classification Search
CPC ..... G03G 21/10; G03G 21/105; G03G 21/12
See application file for complete search history.

(56) References Cited

U.S. PATENT DOCUMENTS 7,974,566 B2 7/2011 Kwon
8,052,781 B2 * 11/2011 Hunter et al. ..... 95/273
(Continued)

FOREIGN PATENT DOCUMENTS

EP 1 865 388 A1 12/2007
JP 2002-311698 10/2002
(Continued)

OTHER PUBLICATIONS

Notification of Transmittal of the International Search Report and the Written Opinion of the International Searching Authority, or the Declaration mailed Feb. 26, 2015 in related International Application No. PCT/KR2015/000843.
(Continued)

*Primary Examiner* — Walter L Lindsay, Jr.
*Assistant Examiner* — Ruifeng Pu
(74) *Attorney, Agent, or Firm* — Staas & Halsey LLP

(57) ABSTRACT

A toner cartridge and an electrophotographic image forming apparatus are provided. The toner cartridge attachable to, or detachable from a main body of an image forming apparatus includes a toner containing unit, a waste toner containing unit that is disposed below the toner containing unit in a gravitational direction and comprises a waste toner inlet through which waste toner flows, a first waste toner transporting member that transports the waste toner from the waste toner inlet in a length direction of the waste toner containing unit, and a second waste toner transporting member that transports the waste toner that is transported in the length direction of the waste toner containing unit in a width direction of the waste toner containing unit to disperse the waste toner in an inner portion of the waste toner containing unit, wherein a rotational center of the second waste toner transporting member is lower than a rotational center of the first waste toner transporting member.

32 Claims, 17 Drawing Sheets

(56) References Cited

U.S. PATENT DOCUMENTS

| | | | | |
|---|---|---|---|---|
| 2002/0150405 | A1 | 10/2002 | Tanisawa et al. | |
| 2007/0280761 | A1* | 12/2007 | Kwon | 399/358 |
| 2008/0089727 | A1* | 4/2008 | Shimizu et al. | 399/360 |
| 2008/0187378 | A1* | 8/2008 | Lim | 399/360 |
| 2009/0060567 | A1* | 3/2009 | Mizuno et al. | 399/111 |
| 2009/0123189 | A1* | 5/2009 | Ichiki et al. | 399/257 |
| 2009/0148189 | A1* | 6/2009 | Fukazawa | 399/238 |
| 2009/0220257 | A1* | 9/2009 | Tsusaka et al. | 399/35 |
| 2010/0021212 | A1* | 1/2010 | Sumii | 399/262 |
| 2010/0183341 | A1* | 7/2010 | Ikeda | 399/255 |
| 2010/0215398 | A1* | 8/2010 | Iikura | 399/111 |
| 2010/0247137 | A1* | 9/2010 | Akaike et al. | 399/110 |
| 2011/0091227 | A1* | 4/2011 | Tomita et al. | 399/35 |
| 2011/0103857 | A1* | 5/2011 | Ohta | 399/360 |
| 2011/0110694 | A1* | 5/2011 | Ishikake | 399/360 |
| 2011/0222940 | A1* | 9/2011 | Sakuma | 399/358 |
| 2011/0222941 | A1* | 9/2011 | Watanabe et al. | 399/360 |
| 2011/0280623 | A1* | 11/2011 | Heo et al. | 399/120 |
| 2011/0293317 | A1* | 12/2011 | Nakano et al. | 399/101 |
| 2012/0014728 | A1 | 1/2012 | Karasawa et al. | |
| 2012/0020698 | A1* | 1/2012 | Fukao | 399/101 |
| 2012/0057896 | A1* | 3/2012 | Maeda | 399/102 |
| 2012/0189345 | A1* | 7/2012 | Kim et al. | 399/120 |
| 2012/0237268 | A1* | 9/2012 | Sakashita et al. | 399/258 |
| 2013/0183065 | A1* | 7/2013 | Nakamura et al. | 399/258 |
| 2013/0216289 | A1* | 8/2013 | Tojo | 399/360 |
| 2013/0272764 | A1* | 10/2013 | Yoshii et al. | 399/358 |
| 2013/0336695 | A1 | 12/2013 | Morishita | |
| 2014/0010579 | A1 | 1/2014 | Yoshino et al. | |
| 2014/0044465 | A1* | 2/2014 | Mekada | 399/358 |
| 2014/0178104 | A1* | 6/2014 | Fowler et al. | 399/258 |
| 2014/0270821 | A1* | 9/2014 | Takahashi | 399/35 |
| 2014/0321867 | A1* | 10/2014 | Imanaka | 399/35 |
| 2014/0376963 | A1* | 12/2014 | Suzuki | 399/123 |
| 2015/0071691 | A1* | 3/2015 | Fujii | 399/350 |
| 2015/0139690 | A1* | 5/2015 | Kim et al. | 399/111 |

FOREIGN PATENT DOCUMENTS

| | | |
|---|---|---|
| JP | 2004-102137 | 4/2004 |
| JP | 2005-257813 | 9/2005 |
| JP | 2007-164096 | 6/2007 |
| JP | 2007-206558 | 8/2007 |
| JP | 2007-286371 | 11/2007 |
| KR | 10-2007-0116423 | 12/2007 |
| KR | 10-2011-0124603 | 11/2011 |

OTHER PUBLICATIONS

Korean Office Action issued Jun. 9, 2015 in corresponding Korean Application No. 10-2014-69958.

European Search Report mailed Oct. 19, 2015 in European Patent Application No. 15 156 416.8.

Office Action mailed Nov. 9, 2015 in European Patent Application No. 15 156 416.8.

Office Action mailed Dec. 16, 2015 in Korean Patent Application No. 10-2014-0069958.

Office Action mailed on Jun. 3, 2016 in corresponding Korean Application No. 10-2014-0069958.

Office Action mailed on Aug. 18, 2016 in corresponding European Application No. 15 156 416.8.

* cited by examiner

TONER CARTRIDGE AND ELECTROPHOTOGRAPHIC IMAGE FORMING APPARATUS USING THE SAME

CROSS-REFERENCE TO RELATED APPLICATIONS

This application is related to, and claims the priority benefit of, Korean Patent Application No. 10-2014-0069958, filed on Jun. 10, 2014 in the Korean Intellectual Property Office, the disclosure of which is incorporated herein in its entirety by reference.

BACKGROUND

1. Field

One or more embodiments of the present invention relate to an image forming apparatus capable of forming an image on a recording medium and a cartridge that is attachable to or detachable from the image forming apparatus.

2. Description of the Related Art

An image forming apparatus using electrophotography prints an image on a recording medium by supplying toner to an electrostatic latent image formed on a photoreceptor to form a visible toner image on the photoreceptor, transferring the visible toner image onto the recording medium, and fusing the transferred visible toner image on the recording medium.

Toner that remains on the photoreceptor after a transfer process is referred to as residual toner. The residual toner on the photoreceptor may pollute a charger that charges the photoreceptor or cause a ghost phenomenon whereby a previous image remains on a next printed image. Accordingly, after transferring the toner, the residual toner may be removed from the photoreceptor before a next image is printed. The removed toner is referred to as waste toner. The waste toner may be stored in a predetermined waste toner storage unit. When an amount of the waste toner stored in the waste toner storage unit is high, the waste toner may leak to the outside, and a driving load of a waste toner dispersion member installed in the waste toner storage unit may increase, thereby causing a driving gear to malfunction.

A process cartridge is an assembly of components for forming a visible toner image. The process cartridge is a consumable product that is detachable from a main body of an image forming apparatus and replaceable after lifespan thereof has ended. A process cartridge may have various structures such as a structure in which a photoreceptor, a development roller that supplies toner to the photoreceptor, and a container portion containing toner may be integrally formed, a structure divided into an image cartridge including a photoreceptor and a development roller and a toner cartridge containing toner, or a structure divided into a photoreceptor cartridge including a photoreceptor, a development cartridge including a development roller, and a toner cartridge containing toner.

The waste toner storage unit may be provided to be adjacent to the photoreceptor. For example, the waste toner storage unit may be provided in the photoreceptor cartridge. When the waste toner storage unit is completely filled with waste toner, the photoreceptor cartridge may have to be replaced even if the lifetime thereof has not terminated, and thus, the photoreceptor cartridge cannot be used for its entire lifetime. A capacity of the waste toner storage unit may be increased, which, however, makes it difficult to provide a photoreceptor cartridge having a compact size. if a member is mounted in the waste toner storage unit to disperse the waste toner, use of the capacity of the waste toner storage unit may be maximized, but, it may be difficult to provide a photoreceptor cartridge that is compact and has a long lifetime.

A waste toner bottle that is separately replaceable from the photoreceptor cartridge may be used as the waste toner storage unit. However, in this case, as the waste toner bottle has to be periodically replaced, user convenience is degraded.

SUMMARY

One or more embodiments of the present invention include a toner cartridge that may stably store waste toner and has a long lifetime, and an electrophotographic image forming apparatus using the toner cartridge.

Additional aspects will be set forth in part in the description that follows and, in part, will be apparent from the description, or may be learned by practice of the presented embodiments.

According to one or more embodiments of the present invention, a toner cartridge that is attachable to or detachable from a main body of an image forming apparatus includes a toner containing unit, a waste toner containing unit that is disposed below the toner containing unit in a gravitational direction and includes a waste toner inlet through which waste toner flows, a first waste toner transporting member that transports the waste toner from the waste toner inlet in a length direction of the waste toner containing unit, and a second waste toner transporting member that transports the waste toner that is transported in the length direction in a width direction of the waste toner containing unit so as to disperse the waste toner in an inner portion of the waste toner containing unit, wherein a rotational center of the second waste toner transporting member is lower than a rotational center of the first waste toner transporting member.

The second waste toner transporting member may include a rotational shaft that extends in the length direction and a plurality of wing portions that externally extend from the rotational shaft, and the plurality of wing portions may include a non-radial type wing portion that is eccentric with respect to a center of the rotational shaft.

The plurality of wing portions may include a radial type wing portion that radially extends from a center of the rotational shaft.

The non-radial type wing portion and the radial type wing portion may be alternately arranged.

At least one of the plurality of wing portions may include an extension portion that externally protrudes from a portion of the wing portions in the length direction.

The extension portion may be formed in a center portion of the wing portions in the length direction.

The extension portion may be slanted toward the waste toner inlet in the length direction.

The extension portion may be formed in the non-radial type wing portions.

The waste toner inlet may be located at a side portion of the waste toner containing unit in the length direction.

The first waste toner transporting member may include a rotational shaft extending in the length direction and a spiral wing formed along the rotational shaft, and a guide wall may be provided near a side wall of the waste toner containing unit to be close to the waste toner inlet, the guide wall blocking the waste toner that is transported by using the first waste toner transporting member in the length direction from being transported in the width direction of the waste toner containing unit.

The guide wall may extend from the side wall in the length direction.

An end portion of the first waste toner transporting member opposite to the waste toner inlet may not include a spiral wing.

A transportation wing that radially extends from the rotational shaft of the first waste toner transporting member and transports the waste toner in the width direction may be provided in a portion not including the spiral wing.

The toner cartridge may include a toner discharging unit including a toner outlet through which toner is discharged from the toner containing unit, and a first toner supply member that supplies the toner from the toner containing unit to the toner discharging unit, wherein the first and second waste toner transporting members are driven in connection with the first toner supply member.

A driving coupler that is connected to a driving unit of the main body when the toner cartridge is mounted in the main body may be mounted at an end portion of the rotational shaft of the first toner supply member.

The first toner supply member and the second waste toner transporting member may rotate in opposite directions to each other.

A plurality of second waste toner transporting members may be arranged in the width direction of the waste toner containing unit.

According to one or more embodiments of the present invention, a toner cartridge that is attachable to or detachable from a main body of an image forming apparatus, the toner cartridge including a toner containing unit, a waste toner containing unit including, at a side portion in a length direction thereof, a waste toner inlet through which waste toner flows, and a waste toner transporting member that is provided in the waste toner containing unit and disperses waste toner into the waste toner containing unit, and includes a rotational shaft that extends in the length direction of waste toner containing unit and a plurality of wing portions that externally extend from the rotational shaft, wherein the plurality of wing portions include a non-radial type wing portion that is eccentric with respect to a center of the rotational shaft.

The plurality of wing portions may include a radial type wing portion that radially extends from the center of the rotational shaft.

The non-radial type wing portion and the radial wing portion may be alternately arranged.

At least one of the plurality of wing portions may include an extension portion that externally protrudes from a portion of the wing portions in the length direction.

The extension portion may be formed in a center portion of the wing portions in the length direction.

The extension portion may be slanted toward the waste toner inlet in the length direction.

The extension portion may be formed in the non-radial type wing portion.

According to one or more embodiments of the present invention, an electrophotographic image forming apparatus includes a main body; and the toner cartridge described above.

The electrophotographic image forming apparatus may include an imaging cartridge that is attachable to or detachable from the main body and includes a photoreceptor on which an electrostatic latent image is formed and a developing roller that supplies toner supplied from the toner cartridge to the photoreceptor to develop the electrostatic latent image.

The electrophotographic image forming apparatus may include a waste toner transporting unit that transports the waste toner removed from the photoreceptor to the waste toner containing unit.

The toner cartridge may be integrally formed with the imaging cartridge.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
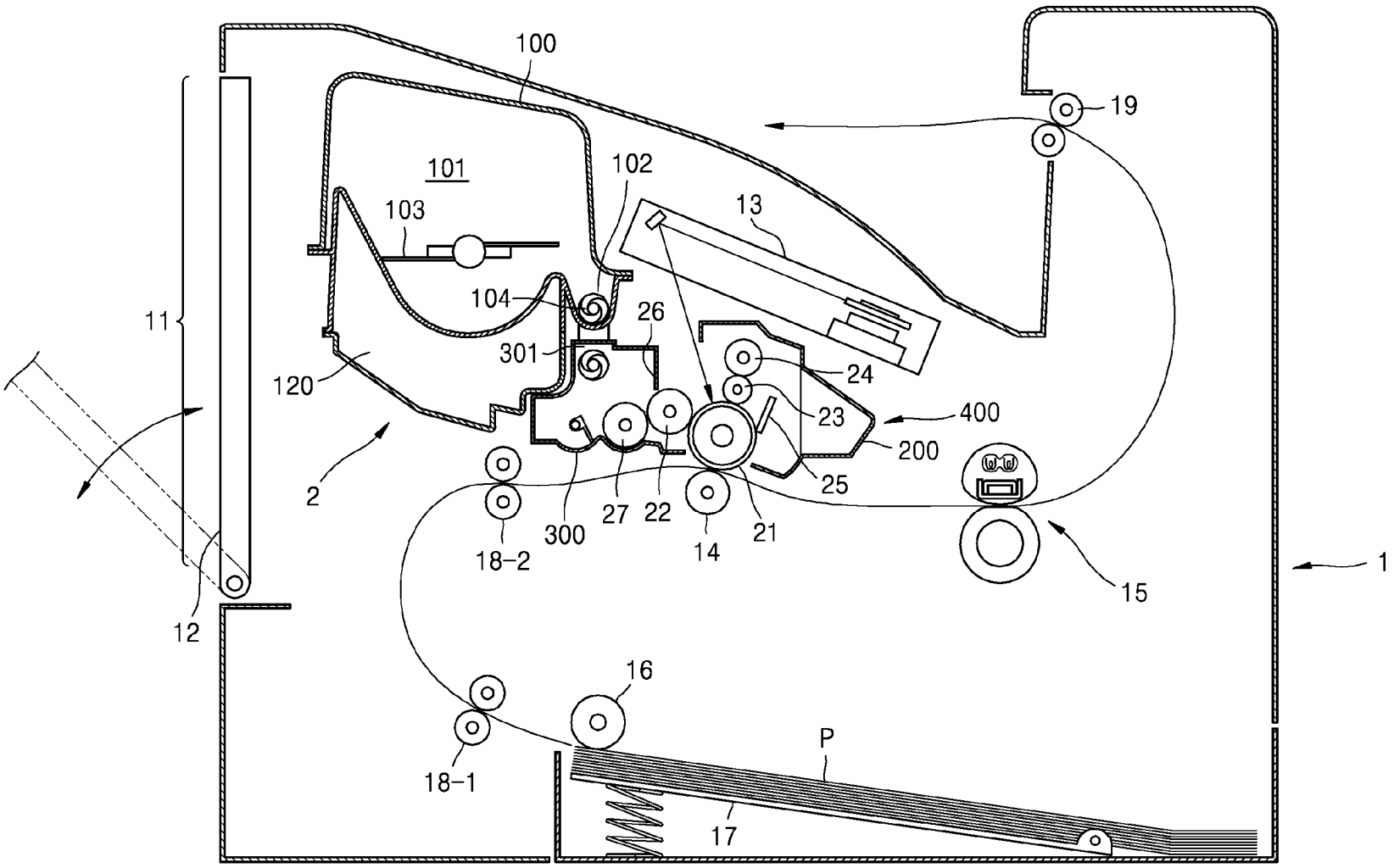
FIG. 1 is a schematic structural diagram of an electrophotographic image forming apparatus according to an embodiment of the present invention.

Reference will now be made in detail to embodiments, examples of which are illustrated in the accompanying drawings, wherein like reference numerals refer to like elements throughout. In the specification and drawings, elements having substantially the same functions and structures will be labeled with the same reference numerals. In this regard, the present embodiments may have different forms and should not be construed as being limited to the descriptions set forth herein. Accordingly, the embodiments are merely described below, by referring to the figures, to explain aspects of the present description. Expressions such as "at least one of," when preceding a list of elements, modify the entire list of elements and do not modify the individual elements of the list.

FIG. 1 is a schematic structural diagram of an electrophotographic image forming apparatus according to an embodiment of the present invention.

Referring to FIG. 1, a main body 1 of the image forming apparatus and a process cartridge 2 are illustrated. The main body 1 includes an opening 11 providing a passage for the process cartridge 2 to be mounted in, or removed from, the main body 1. A door 12 closes, or opens, the opening 11. The main body 1 includes an exposure unit 13, a transfer roller 14, and a fusing unit 15. The main body 1 includes a recording medium transfer structure for loading and transferring a recording medium P where an image is to be formed.

The process cartridge 2 may include a toner containing unit 101, a photoconductive drum 21, on a surface of which an electrostatic latent image is formed, and a development roller 22 that receives toner from the toner containing unit 101 to supply the toner to the electrostatic latent image so as to develop the electrostatic latent image into a visible toner image.

The process cartridge 2 may have an exemplary first structure divided into an imaging cartridge 400 including the photoconductive drum 21 and the development roller 22 and a toner cartridge 100 including the toner containing unit 101, an exemplary second structure divided into a photoreceptor cartridge 200 including the photoconductive drum 21, a development cartridge 300 including the development roller 22, and a toner cartridge 100 including the toner containing unit 101, an exemplary third structure divided into a photoreceptor cartridge 200 and a development cartridge 300 including the toner containing unit 101, or an exemplary fourth structure in which a photoreceptor cartridge 200, a development cartridge 300, and a toner cartridge 100 are integrally formed with one another.

In the process cartridge 2 having the first structure (or the second structure), when the toner cartridge 100 is mounted in the main body 1, the toner cartridge 100 may be connected to the imaging cartridge 400 (or the development cartridge 300). For example, when the toner cartridge 100 is mounted in the main body 1, a toner discharging unit 102 of the toner cartridge 100 and a toner inlet portion 301 of the imaging cartridge 400 (or the development cartridge 300) may be connected to each other.

Figure 2:
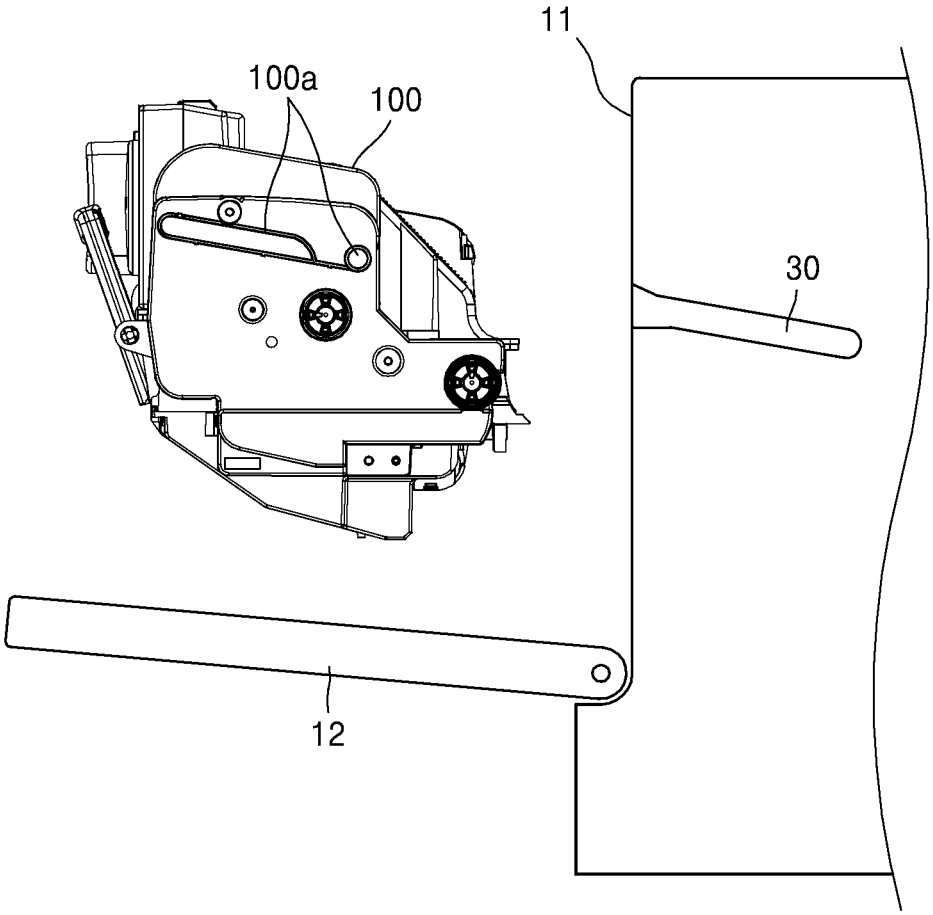
FIG. 2 illustrates an exemplary replacement of a toner cartridge.

For example, the process cartridge 2 according to an embodiment has the first structure. The imaging cartridge 400 and the toner cartridge 100 may be individually attached to, or detached from, the main body 1. The process cartridge 2 is a consumable product that is replaced, for example, after its lifespan expires. In general, the lifespan of the imaging cartridge 400 may be longer than the lifespan of the toner cartridge 100. When toner included in the toner cartridge 100 is completely consumed, just the toner cartridge 100 may be individually replaced as illustrated in FIG. 2, and thus, costs for replacement of consumables may be reduced. Referring to FIG. 2, for example, a guide protrusion 100*a* may be formed on a side portion of the toner cartridge 100, and a guide rail 30 that guides the guide protrusion 100*a* may be provided in the main body 1. The toner cartridge 100 may be guided via the guide rail 30 to be attached to, or detached from, the main body 1. While not illustrated in the drawing, a guide unit that guides the imaging cartridge 400 may be provided in the main body 1.

The photoreceptor cartridge 200 includes the photoreceptor drum 21. The photoconductive drum 21 is an example of a photoreceptor, an electrostatic latent image being formed on a surface thereof, and may include a conductive metal pipe and a photosensitive layer around the conductive metal pipe. A charging roller 23 is an example of a charger for charging the photoconductive drum 21 to have a uniform surface potential. A charging brush or a corona charger may be used instead of the charging roller 23. A cleaning roller 24 may be used for removing foreign materials from a surface of the charging roller 23. A cleaning blade 25 is an example of a cleaning unit for removing toner and foreign materials from a surface of the photoconductive drum 21 after a transfer process which will be described later. A cleaning unit having another shape, such as a rotating brush, may be used instead of the cleaning blade 25.

The development cartridge 300 receives toner from the toner cartridge 100 and supplies the toner to the electrostatic latent image formed on the photoconductive drum 21 so that the electrostatic latent image formed on the photoconductive drum 21 may be developed into the visible toner image.

Figure 3A:
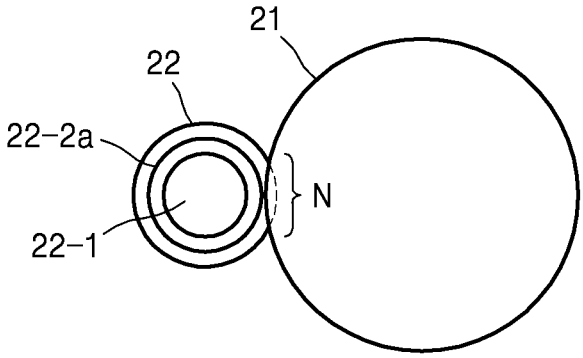
FIG. 3A is a diagram of an arrangement of a photoconductive drum and a development roller according to an exemplary contact development method.
Figure 3B:
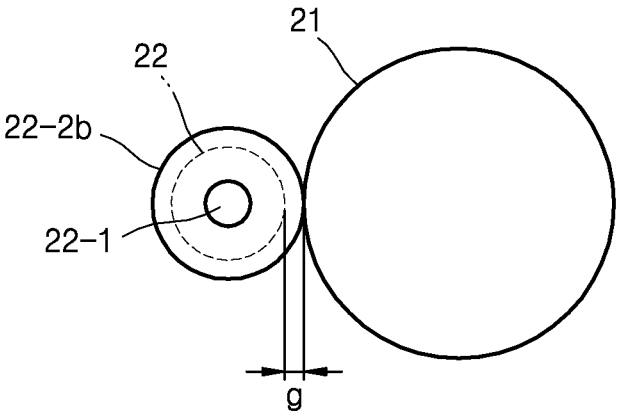
FIG. 3B is a diagram of an arrangement of a photoconductive drum and a development roller according to in exemplary non-contact development method.

Examples of a development method include a one-component development method in which toner is used and a two-component development method in which toner and a carrier are used. The development cartridge 300 according to an embodiment uses a one-component development method. The development roller 22 is used to supply toner to the photosensitive drum 21. A development bias voltage to supply toner to the photosensitive drum 21 may be applied to the development roller 22. The one-component development method may be classified into a contact development method, wherein the development roller 22 and the photoconductive drum 21 may be rotated while contacting each other, and a non-contact development method, wherein the development roller 22 and the photoconductive drum 21 may be rotated by being spaced apart from each other by dozens to hundreds of microns. FIG. 3A is a diagram of an exemplary arrangement of the photoconductive drum 21 and the development roller 22 in the contact development method, and FIG. 3B is a diagram of an exemplary arrangement of the photoconductive drum 21 and the development roller 22 in the non-contact development method. Referring to FIG. 3A, in the contact development method, a gap maintaining member 22-2*a* having a smaller diameter than the development roller 22 may be provided on each of both ends of a rotation shaft 22-1 of the development roller 22. A contact amount of the development roller 22 to the photoconductive drum 21 may be constrained by the gap maintaining member 22-2*a* that contacts the surface of the photoconductive drum 21. A development nip N may be formed as the development roller 22 contacts the photoconductive drum 21. Referring to FIG. 3B, in the non-contact development method, a gap maintaining member 22-2*b* having a larger diameter than the development roller 22 may be provided on each of the both ends of the rotation shaft 22-1 of the development roller 22. A development gap g between the development roller 22 and the photoconductive drum 21 may be constrained by the gap maintaining member 22-2*b* that contacts the surface of the photoconductive drum 21. To maintain the development gap g and the development nip N, it may be sufficient that the gap maintaining members 22-2*a* and 22-2*b* contact an object, and the gap maintaining members 22-2*a* and 22-2*b* do not necessarily have to contact the surface of the photoconductive drum 21.

A regulator 26 regulates an amount of toner supplied from the development roller 22 to a development region where the photoconductive drum 21 and the development roller 22 face each other. The regulator 26 may be a doctor blade elastically contacting a surface of the development roller 22. A supply roller 27 supplies toner in the process cartridge 2 to a surface of the development roller 22. A supply bias voltage may be applied to the supply roller 27.

When a two-component development method is used, the development roller 22 may be spaced apart from the photoconductive drum 21, for example, in an order of dozens to hundreds of microns. Although not illustrated in the drawings, the development roller 22 may have a structure in which a magnetic roller is disposed in a hollow cylindrical sleeve. The toner may be adhered to a surface of a magnetic carrier. The magnetic carrier may be adhered to the surface of the development roller 22 to be transferred to the development region where the photoconductive drum 21 and the development roller 22 face each other. Only the toner may be supplied to the photoconductive drum 21 according to the development bias voltage applied between the development roller 22 and the photoconductive drum 21, and thus the electrostatic latent image formed on the surface of the photoconductive drum 21 is developed into the visible toner image. The process cartridge 2 may include an agitator (not illustrated) for mixing and stirring the toner and a carrier and transporting the mixture to the development roller 22. The agitator may be, for example, an auger, and a plurality of agitators may be provided in the process cartridge 2.

The exposure unit 13 forms the electrostatic latent image on the photoconductive drum 21 by irradiating light modulated according to image information to the photoconductive drum 21. The exposure unit 13 may be a laser scanning unit (LSU) using a laser diode as a light source, or a light-emitting diode (LED) exposure unit using an LED as a light source.

The transfer roller 14 is an example of a transfer unit for transferring a toner image from the photoconductive drum 21 to the recording medium P. A transfer bias voltage for transferring the toner image to the recording medium P may be applied to the transfer roller 14. A corona transfer unit or a transfer unit using a pin scorotron method may be used instead of the transfer roller 14.

The recording media P may be picked up one by one from a loading table 17 by a pickup roller 16, and transferred by feed rollers 18-1 and 18-2 to a region where the photoconductive drum 21 and the transfer roller 14 face each other.

The fusing unit 15 applies heat and pressure to an image transferred to the recording medium P so as to fuse and fix the image on the recording medium P. The recording medium P that passed through the fusing unit 15 may be discharged outside the main body 1 by a discharge roller 19.

According to an embodiment, the exposure unit 13 irradiates the light modulated according to the image information to the photoconductive drum 21 to develop the electrostatic latent image. The development roller 22 supplies the toner to the electrostatic latent image to form the visible toner image on the surface of the photoconductive drum 21. The recording medium P loaded in the loading table 17 may be transferred to the region where the photoconductive drum 21 and the transfer roller 14 face each other by the pickup roller 16 and the feed rollers 18-1 and 18-2, and the toner image may be transferred on the recording medium P from the photoconductive drum 21 according to the transfer bias voltage applied to the transfer roller 14. After the recording medium P passes through the fusing unit 15, the toner image may be fused and fixed on the recording medium P according to heat and pressure. After the fusing, the recording medium P may be discharged by the discharge roller 19.

The photoreceptor cartridge 200 and the development cartridge 300 that form the imaging cartridge 400 may be respectively referred to as the photoreceptor unit 200 and the developing unit 300. The photoreceptor unit 200 and the development unit 300 may be connected to each other such that the development nip N or the development gap g is maintained.

Figure 4:
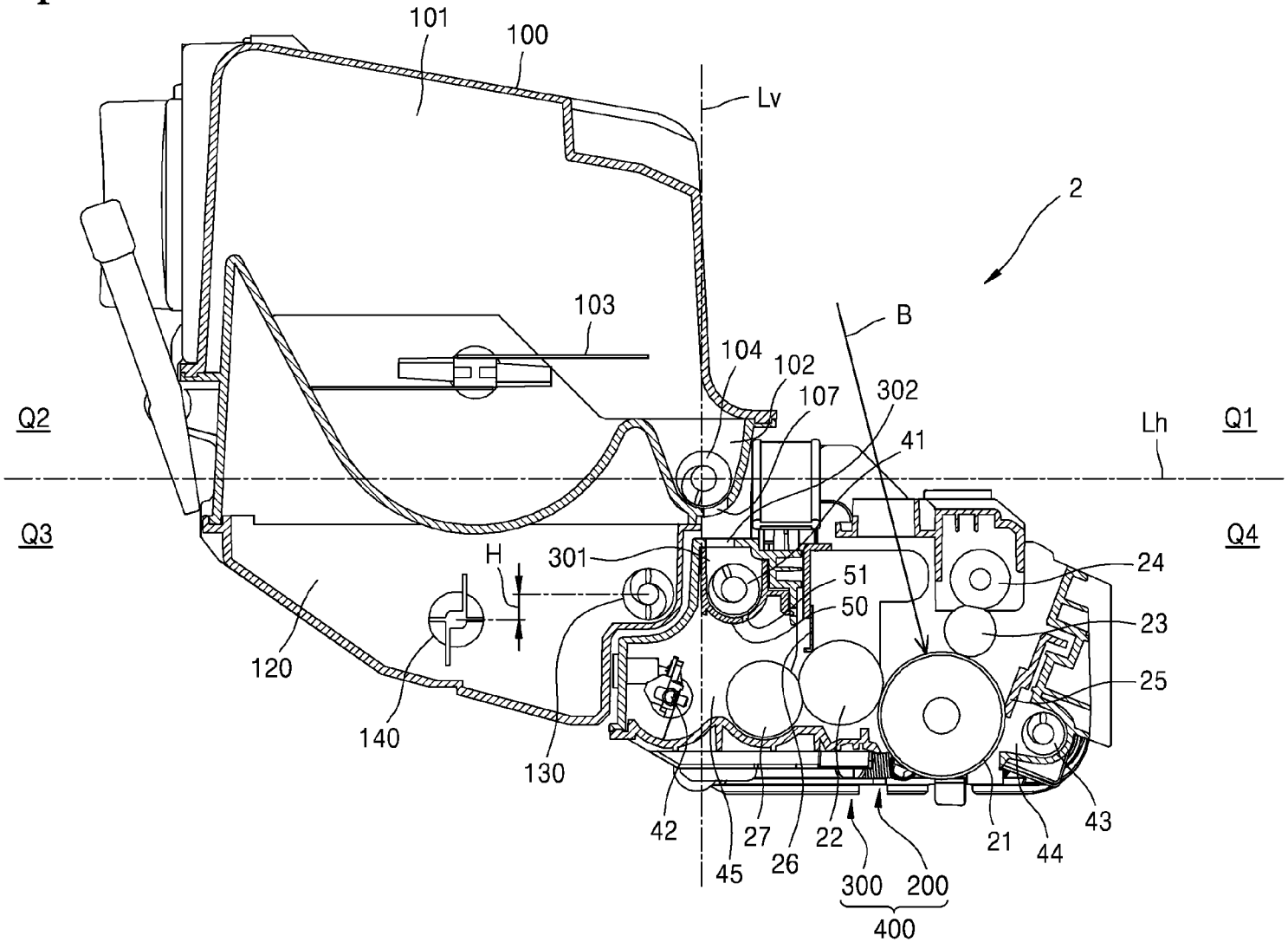
FIG. 4 is a cross-sectional view of a process cartridge according to an embodiment.

FIG. 4 is a cross-sectional view of the process cartridge 2 according to an embodiment. Referring to FIG. 4, the development unit 300 may be disposed below the toner containing unit 101 in a gravitational direction. According an embodiment, toner in the toner containing unit 101 may be easily supplied to the development unit 300 due to gravity.

The toner contained in the toner containing unit 101 may be discharged from the toner cartridge 100 through a toner outlet 107 provided at the toner discharging unit 102 and supplied to the inner space of the development unit 300, that is, to a development chamber 45, through a toner inlet 302 provided at the toner inlet portion 301. The toner inlet 302 may be disposed to face the toner outlet 107. The length direction of the toner discharging unit 102 and the toner inlet portion 301 refers to an axial direction of the photoconductive drum 21, the supply roller 27, and the development roller 22.

A first toner supply member 103 that supplies toner to the toner discharging unit 102 may be disposed in the toner containing unit 101. A second toner supply member 104 that transports toner to the toner outlet 107 disposed at the end portion of the toner discharging unit 102 may be disposed in the toner discharging unit 102. The first toner supply member 103 radially transports the toner to supply the same to the toner discharging unit 102. For example, a paddle having a rotational shaft and agitation wings that extend radially may be used as the first toner supply member 103. The second toner supply member 104 transports the toner supplied by using the first toner supply member 103 in the length direction. For example, an auger including a rotational shaft and spiral wings may be used as the second toner supply member 104.

A first toner transporting member 41 that transports toner in the length direction may be disposed in the toner inlet portion 301. For example, an auger having a rotational shaft and spiral wings may be used as the first toner transporting member 41. A toner supply guide 50 that extends in the length direction may be disposed under the first toner transporting member 41. The toner supply guide 50 may be disposed above the supply roller 27 in a gravitational direction. For example, the toner supply guide 50 may have a shape surrounding a lower portion of the first toner transporting member 41 disposed thereinside. A slit 51 may be formed in the toner supply guide 50. Toner that is transported by using the first transporting member 41 in the length direction may drop into the inner space of the development unit 300 (the development chamber 45) through the slit 51. The toner may drop, e.g., immediately drop on a surface of the supply roller 27 and part of the toner may drop into the development chamber 45.

A second toner transporting member 42 may be disposed in the development unit 300. The second toner transporting member 42 supplies to the supply roller 27 the toner that is not immediately supplied from the toner inlet 302 to the surface of the supply roller 27 and supplied to the development chamber 45 and toner that is separated from the surface of the supply roller 27. For example, a paddle that radially transports toner may be used as the second toner transporting member 42.

Toner that remains on the surface of the photoconductive drum 21 after the transfer may be removed from the surface of the photoconductive drum 21 by using the cleaning blade 25. The removed waste toner may be stored in the waste toner accommodation space 44. A waste toner discharging member 43 that transports the waste toner in an axial direction may be disposed in the waste toner accommodation space 44. The waste toner discharging member 43 may be, for example, an auger that includes a rotational shaft and spiral wings. The waste toner may be carried to an end portion of the waste toner accommodation space 44 in a length direction (that is, in an axial direction of the waste toner discharging member 43) by using the waste toner transporting member 43 to be discharged from the waste toner accommodation space 44.

A waste toner containing unit 120 may be provided below the toner containing unit 101. The waste toner containing unit 120 may be connected to the waste toner accommodation space 44 via a waste toner transporting unit 60 (see, for example, FIG. 5). The waste toner may be carried to the waste toner containing unit 120 by using the waste toner transporting unit 60 provided in the imaging cartridge 400 and is stored in the waste toner containing unit 120. Waste toner dispersing (transporting) members 130 and 140 that disperse the waste toner inside the waste toner containing unit 120 may be disposed in the waste toner containing unit 120.

As illustrated in FIG. 4, the process cartridge 2 may be divided into four quadrants Q1, Q2, Q3, and Q4 by a vertical line Lv and a horizontal line Lh with respect to the second toner supply member 104 as the origin. When the toner containing unit 101 and the first toner supply member 103 are located in the second quadrant Q2, the supply roller 27, the development roller 22, and the photoconductive drum 21 are located in the fourth quadrant Q4 that is in a diagonal direction to the second quadrant Q2. According to an embodiment, toner may be spontaneously supplied from the toner containing unit 101 to the development unit 300 due to gravity. The waste toner containing unit 120 and the waste toner dispersing (transporting) members 130 and 140 are located in the third quadrant Q3 below the second quadrant Q2. According an embodiment, a step between the waste toner discharging member 43 and the waste toner containing unit 120 in a gravitational direction may be reduced, and thus, the waste toner removed from the photoconductive drum 21 is easily transported to the waste toner containing unit 120. The first toner transporting member 41 may be located in the fourth quadrant Q4. A capacity of the waste toner containing unit 120 is relatively small compared to that of the toner containing unit 101. Accordingly, the inner space of the development unit 300 extends from the fourth quadrant Q4 to the third quadrant Q3, and the second toner transporting member 42 may be disposed in the extended portion. That is, the second toner transporting member 42 is located in the third quadrant Q3. Accordingly, the development unit 300 and the photoreceptor unit 200 may be efficiently arranged in the third quadrant Q3 and the fourth quadrant Q3 so as to reduce a length of the process cartridge 2 or the imaging unit (imaging cartridge) 400. Light B that reaches the photoconductive drum 21 passes through the first quadrant Q1 and is incident on the photoconductive drum 21.

A lifetime of the toner cartridge 100 is usually shorter than that of the photoreceptor cartridge 200 or the imaging cartridge 400. As the waste toner containing unit 120 may be provided in the toner cartridge 100, the waste toner containing unit 120 may also be replaced when the toner cartridge 100 is replaced. Thus, the lifetime of the photoreceptor cartridge 200 or the imaging cartridge 400 may not be affected by an amount of waste toner. Consequently, the photoreceptor cartridge 200 or the imaging cartridge 400 may have a long lifetime. A space for storing waste toner may be removed from or minimized in the photoreceptor cartridge 200 or the imaging cartridge 400, and thus, the photoreceptor cartridge 200 or the imaging cartridge 400 may have a compact size.

Figure 5:
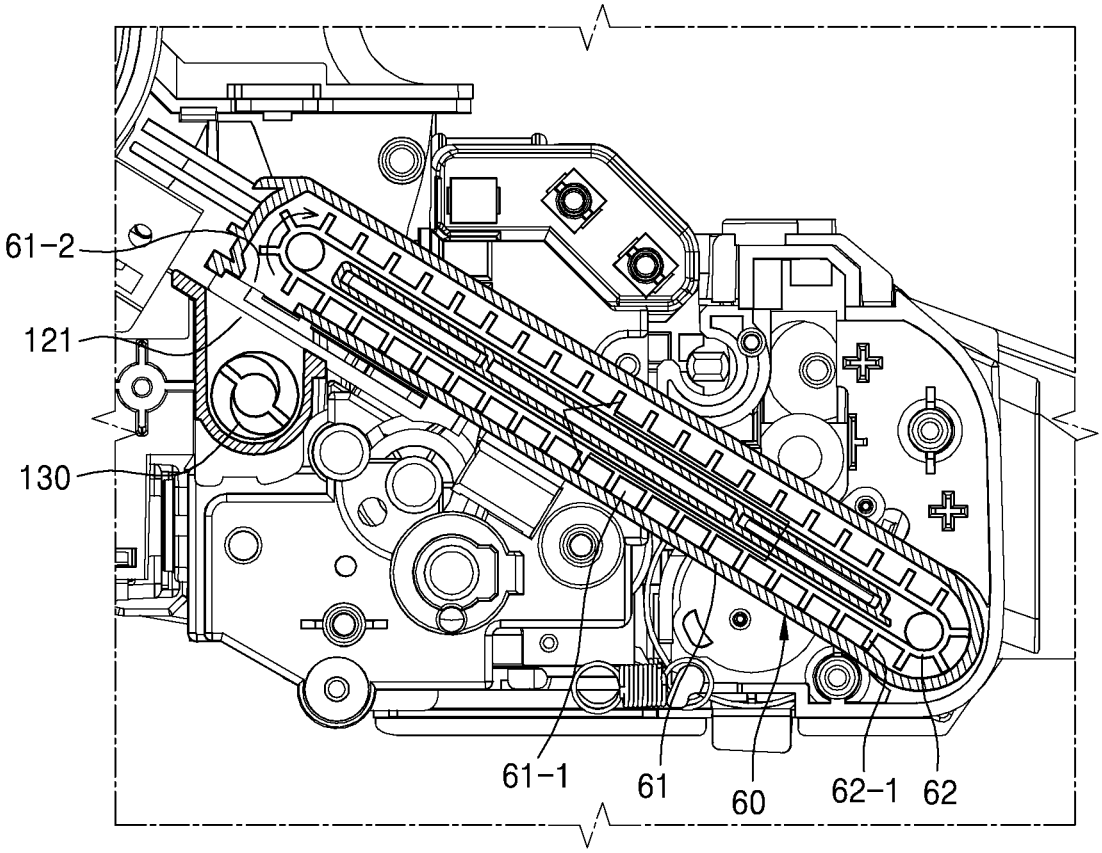
FIG. 5 is a schematic structural diagram of a waster toner transporting unit according to an embodiment.

FIG. 5 is a schematic structural diagram of the waster toner transporting unit 60 according to an embodiment. Referring to FIGS. 4 and 5, a waste toner inlet 121 through which waste toner introduced into the waste toner containing unit 120 may be provided at a side portion of the waste toner containing unit 120 provided in the toner cartridge 100. The waste toner transporting unit 60 connects the waste toner accommodation space 44 and the waste toner containing unit 120. The waste toner transporting unit 60 includes a connection member 161 that connects an end portion of the waste toner accommodation space 44 and the waste toner inlet 121. The connection member 61 includes, for example, a waste toner transportation path 61-1 through which waste toner may pass. The waste toner accommodation space 44 may be located below the waste toner inlet 121, and thus, the waste toner transportation path 61-1 extends obliquely and upwardly from the waste toner accommodation space 44 to an upper portion of the waste toner inlet 121. A waste toner outlet 61-2 facing the waste toner inlet 121 may be provided in the connection member 61. The waste toner outlet 61-2 may be disposed at an upper portion of the waste toner inlet 121.

While not illustrated in the drawings, a shutter (not illustrated) that opens or closes the waste toner outlet 61-2 is provided in the imaging cartridge 400. The shutter may be maintained by using, for example, a spring (not illustrated) at a position to close the waste toner outlet 61-2. When the toner cartridge 100 is mounted in the main body 1, the shutter may be moved to open the waste toner outlet 61-2 via a shutter open/closing mechanism (not illustrated) provided in the toner cartridge 100. When mounting of the toner cartridge 100 is completed, the waste toner inlet 121 may be located below the waste toner outlet 61-2 that is opened, and accordingly, the waste toner outlet 61-2 and the waste toner inlet 121 may be connected to each other. When the toner cartridge 100 is detached from the main body 1, the shutter may be moved to close the waste toner outlet 61-2, for example, via an elastic force of the spring.

The waste toner removed from the photoconductive drum 21 and collected in the waste toner accommodation space 44 may be transported in an axial direction by using the waste toner discharging member 43 to flow into the waste toner transportation path 61-1. The waste toner may be transported along the waste toner transportation path 61-1 due to a transportation force of the waste toner discharging member 43, and when the waste toner arrives at the waste toner outlet 61-2, it drops into the waste toner inlet 121 due to gravity.

Accordingly, the waste toner may be carried from the photoconductive unit 200 (or the imaging cartridge 400) to the toner cartridge 100 and is stored in the waste toner containing unit 120.

The waste toner may be carried to the waste toner containing unit 120 along the waste toner transportation path 61-1 by the transportation force of the waste toner discharging member 43. A transportation member 62 that transports the waste toner to the waste toner outlet 61-2 may be further disposed on the waste toner transportation path 61-1. As illustrated in FIG. 5, the transportation member 62 may be a belt that includes a plurality of transportation wings 62-1 and may be disposed to circulate along the waste toner transportation path 61-1. However, the transportation member 62 is not limited to the circulating belt illustrated in FIG. 5. The transportation member 62 may be disposed around the waste toner outlet 61-2 to raise the waste toner, which is transported by the waste toner discharging member 43 along the waste toner transportation path 61-1, to the waste toner outlet 121. For example, although not illustrated in the drawings, as the transportation member 62, various structures that transport the waste toner to the waste toner outlet 121 such as a rotating spiral coil member or a paddle may be used. A transportation member (not illustrated) in the form of a spiral coil may extend to be close to the waste toner discharging member 43 along the waste toner transportation path 61-1. A plurality of transportation members (not illustrated) in the form of paddles may be disposed along the waste toner transportation path 61-1.

Figure 6:
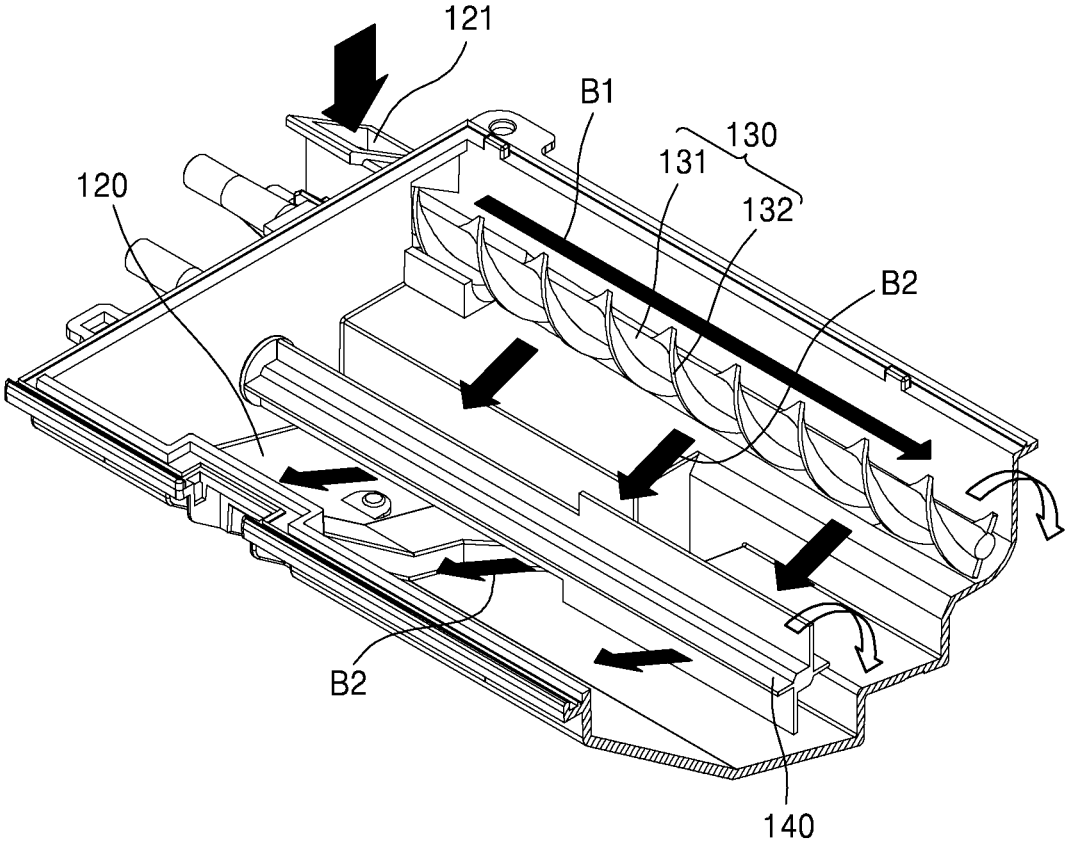
FIG. 6 is a perspective view of a waster toner containing unit according to an embodiment.

FIG. 6 is a perspective view of the waster toner containing unit 120 according to an embodiment. Referring to FIGS. 4 and 6, a plurality of waste toner transportation members may be disposed in the waste toner containing unit 120. The waste toner transportation members may include the first waste toner transporting member 130. As the first waste toner transporting member 130, for example, an auger including a rotational shaft 131 and spiral wings 132 may be used. Waste toner may be transported by the first waste toner transporting member 130 in an axial direction. The first waste toner transporting member 130 may be disposed adjacent to the waste toner inlet 121, and an end portion of the first waste toner transporting member 130 extends up to an area below the waste toner inlet 121. By using the first waste toner transporting member 130, the waste toner may be carried from the waste toner inlet 121 into the waste toner containing unit 120 and may be transported in a length direction B1 of the waste toner containing unit 120.

Figure 7:
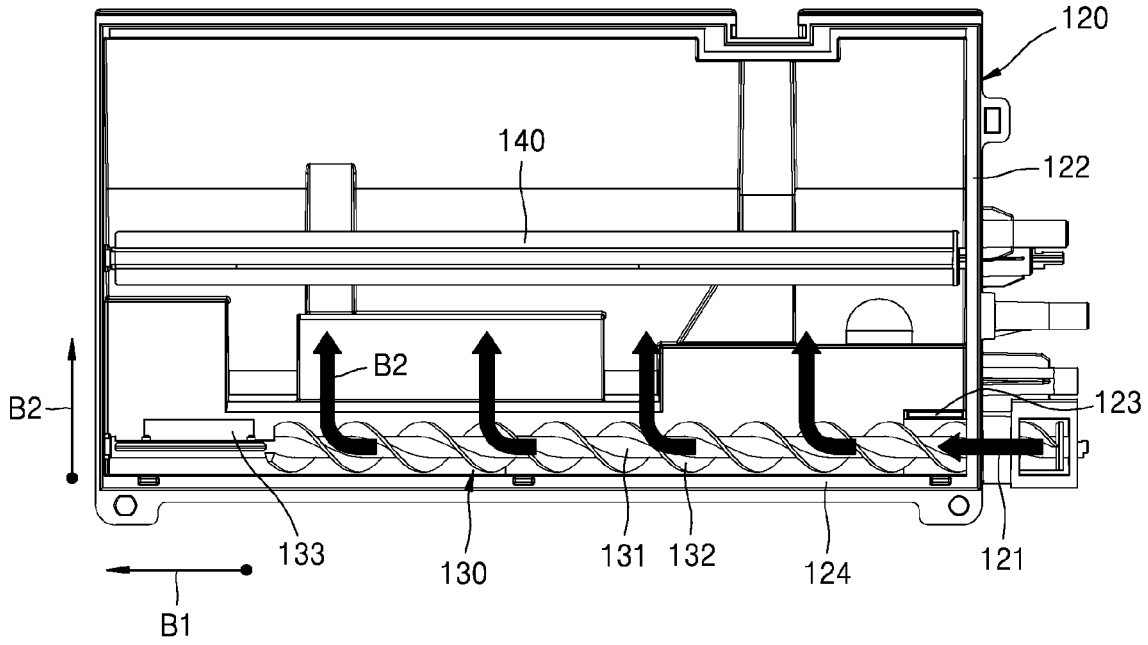
FIG. 7 is a plan view of an exemplary waste toner containing unit.

FIG. 7 is an exemplary plan view of the waste toner containing unit 120. Referring to FIG. 7, a guide wall 123 that inwardly extends around a side wall 122 of the waste toner containing unit 120 adjacent to the waste toner inlet 121, that is, in an axial direction (length direction) of the first waste toner transporting member 130, is illustrated. The guide wall 123 blocks the waste toner around the side wall 122 adjacent the waste toner inlet 121 from being transported in a width direction B2 crossing the length direction B1 into the waste toner containing unit 120. The guide wall 123 may extend from the side wall 122 in the length direction B1.

According to an embodiment, the waste toner may be transported by using the first waste toner transporting member 130 in an axial direction. When the waste toner passes through the side wall 122 of the waste toner containing unit 120 to flow into the waste toner containing unit 120, a capacity of a portion around the first waste toner transporting member 130 abruptly increases. A transportation force of the first waste toner transporting member 130 may be rapidly decreased, and the waste toner may not be easily transported in the length direction B1 and may be accumulated near the side wall 122 close to the waste toner inlet 121. Thus, the internal space of the waste toner containing unit 120 may not be efficiently used. In addition, due to the waste toner that is accumulated just near the side wall 122, the waste toner may not be effectively supplied to the waste toner containing unit 120, and thus, when the waste toner is filled in the waste toner accommodation space 44 and the waste toner transporting unit 60 of the imaging cartridge 400, a pressure of the waste toner in the waste toner accommodation space 44 may increase and the waste toner may leak to the outside.

According to an embodiment, the end portion of the first waste toner transporting member 130 close to the side wall 122 may be located in a limited transportation space formed by the guide wall 123 and a side wall 124 of the waste toner containing unit 120 in the length direction B1. Thus, the transportation force of the first waste toner transporting member 130 may be maintained so that the waste toner that has traveled through the waste toner inlet 121 may be effectively transported in the length direction B1 of the waste toner containing unit 120.

The waste toner transported by using the first waste toner transporting member 130 in the length direction B1 may be accumulated around the first waste toner transporting member 130, and is pushed away in the width direction B2, that is, into the waste toner containing unit 120. An area of the waste toner containing unit 120 near the waste toner inlet 121 may be blocked by the guide wall 123, and thus, no waste toner is accumulated there, and the waste toner is mainly accumulated in a center portion of the waste toner containing unit 120 in the length direction B1. An amount of the waste toner transported by using the first waste toner transporting member 130 decreases toward the opposite area of the waste toner containing unit 120 to the waste toner inlet 121. Accordingly, spiral wings 132 may not be disposed at an end portion of the first waste toner transporting member 130 opposite the waste toner inlet 121. Transportation wings 133 that radially extend to transport the waste toner, that is, in the width direction B2 that crosses the length direction B1, may be disposed at the end portion of the first waste toner transporting member 130 opposite the waste toner inlet 121. The waste toner may be transported into the waste toner containing unit 120 via the transportation wings 133.

The waste toner transported to the waste toner containing unit 120 by using the first waste toner transporting member 130 may be accumulated around the first waste toner transporting member 130. The waste toner accumulated around the first waste toner transporting member 130 may act as a load on the waste toner discharging member 43 and the first waste toner transporting member 130, thereby decreasing a waste toner transportation efficiency, and also may cause step out of or damages to a driving unit such as a gear that drives the waste toner discharging member 43 and the first waste toner transporting member 130.

Referring to FIGS. 6 and 7, according to an embodiment, the waste toner transportation member includes the second waste toner transporting member 140 that carries waste toner that may be moved from the first waste toner transporting member 130 in the width direction B2 to disperse the waste toner into the waste toner containing unit 120. The second waste toner transporting member 140 transports the waste toner in the width direction B2 of the waste toner containing unit 120. The second waste toner transporting member 140 transports the waste toner moved, e.g., that is slowly moved into the waste toner containing unit 120 in an arrow direction B2 by the first waste toner transporting member 130 so as to disperse the waste toner around the first waste toner transporting member 130 into the waste toner containing unit 120. Accordingly, an increase in a driving load of the first waste toner transporting member 130 may be prevented, and the waste toner may be effectively carried into, and stored in, the waste toner containing unit 120.

Referring to FIG. 4, the second waste toner transporting member 140 may be located further below than the first waste toner transporting member 130 in a gravitational direction. That is, a height difference H exists between a rotational center of the second waste toner transporting member 140 and a rotational center of the first waste toner transporting member 130. According to an embodiment, the waster toner that is moved by the first waste toner transporting member 130 in the width direction B2 spontaneously flows downward due to gravity, and the waste toner may be carried in the width direction B2 by using the second waste toner transporting member 140, thereby improving a storage efficiency of the waste toner containing unit 120.

Figure 8:
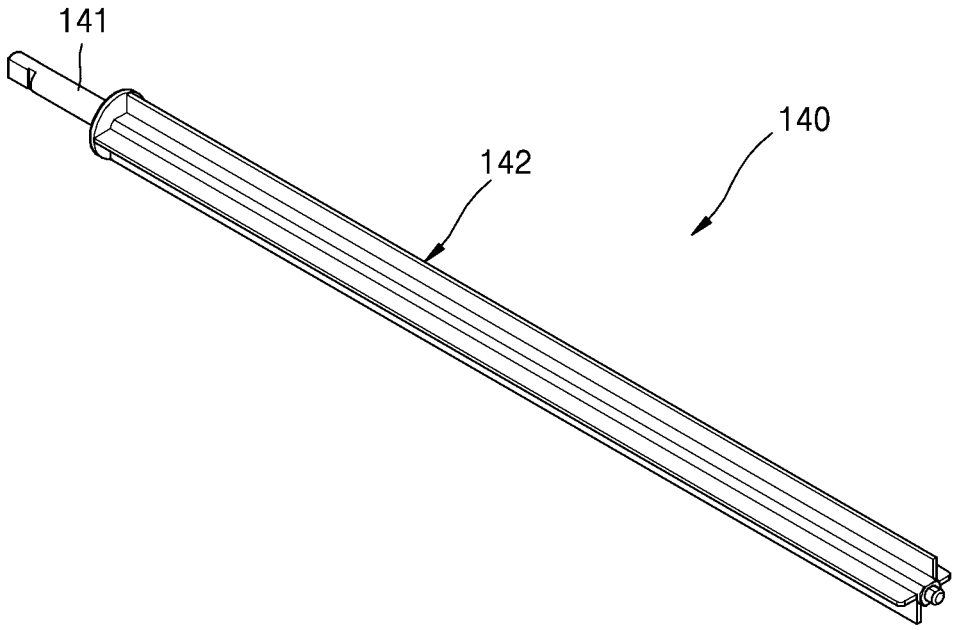
FIG. 8 is a perspective view of a second waste toner transporting member according to an embodiment.
Figure 9:
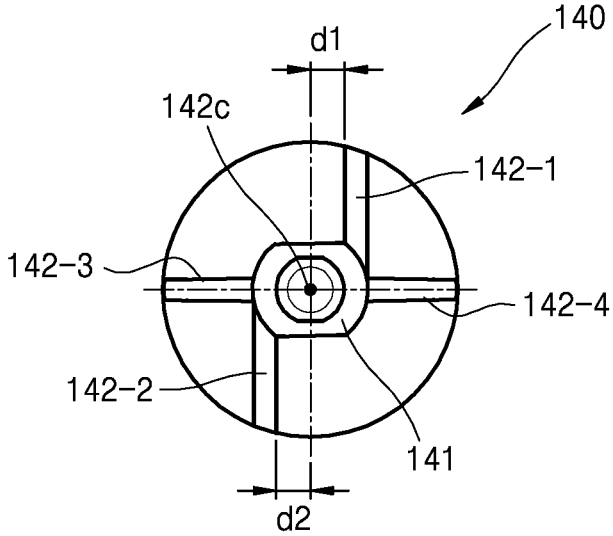
FIG. 9 is a side view of a second waste toner transporting member according to an embodiment.

FIG. 8 is a perspective view of the second waste toner transporting member 140 according to an embodiment. FIG. 9 is a side view of the second waste toner transporting member 140 illustrated, for example, in FIG. 8 according to an embodiment. Referring to FIGS. 8 and 9, the second waste toner transporting member 140 may include a rotational shaft 141 and a plurality of wing portions 142 that are externally extended from the rotational shaft 141. The plurality of wing portions 142 include non-radial wing portions that may deviate from a center 142*c* of the rotational shaft 141. The plurality of wing portions 142 may include radial wing portions that radially extend from the center 142*c* of the rotational shaft 141. The radial wing portions and the non-radial wing portions may be alternately arranged.

For example, the second waste toner transporting member 140 according to an embodiment includes four wing portions 142-1 through 142-4. Two wing portions 142-3 and 142-4 are radial type wing portions that radially extend with respect to the center 142*c* of the rotational shaft 141. Two wing portions 142-1 and 142-2 are non-radial type wing portions that are respectively eccentric with respect to the center 142*c* by distances d1 and d2. The distances d1 and d2 may be the equal to, or different from, each other. According to an embodiment, the two non-radial wing portions 142-1 and 142-2 have a rotational phase difference with respect to the two radial wing portions 142-3 and 142-4. That is, at least one of the plurality of wing portions 142 of the second waste toner transporting member 140 has a rotational phase difference with respect to the other wing portions. The effect of the above structure will be described with reference to FIGS. 10 and 11 by comparing with an embodiment with no rotational phase difference.

Figure 10:
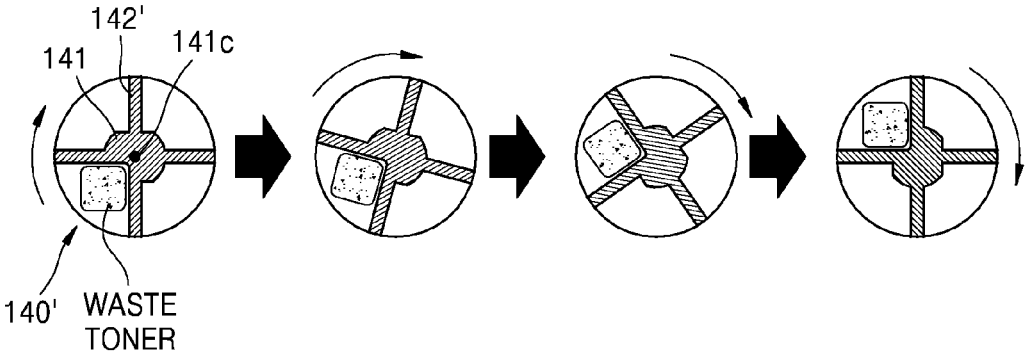
FIG. 10 illustrates an exemplary transportation of waste toner by using the second waste toner transporting member without a rotational phase difference.

FIG. 10 illustrates an exemplary transportation of waste toner by using a second waste toner transporting member 140' without a rotational phase difference. Referring to FIG. 10, all four wing portions 142' extend from the center 142*c* of the rotational shaft 141 in a radial direction. Thus, the four wing portions 142' have the same rotational phase difference. According to an embodiment, although the second waste toner transporting member 140' rotates, waste toner located between the wing portions 142', that is, the waste toner that is close to the rotational shaft 141, may not be transported in a radial direction but rotates together with the second waste toner transporting member 140'. Thus, an effect of transporting the waste toner in a radial direction, that is, in the arrow direction B2 of FIG. 6, may not be sufficiently provided.

Figure 11:
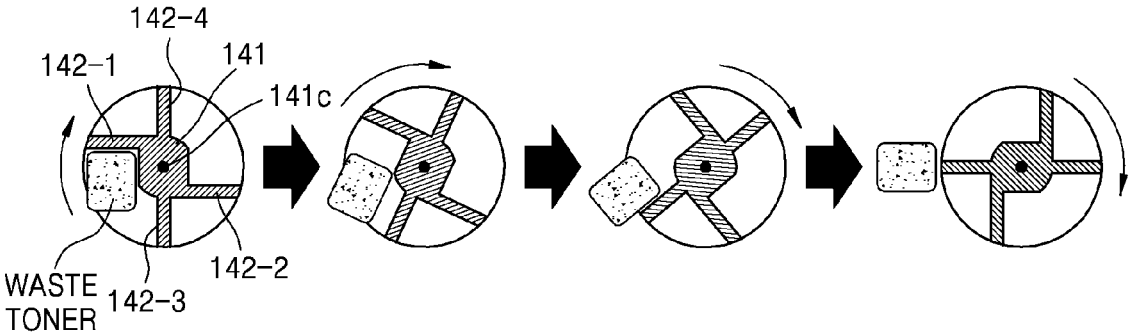
FIG. 11 illustrates an exemplary transportation of waste toner by using the second waste toner transporting member.

FIG. 11 illustrates an exemplary transportation of waste toner by using the second waste toner transporting member 140 illustrated, for example, in FIGS. 8 and 9. Referring to FIG. 11, waster toner between the non-radial type wing portion 142-1 and the radial type wing portion 142-3 adjacent thereto may be gradually pushed away in a radial direction as the second waste toner transporting member 140 rotates. Accordingly, the waste toner may be effectively transported in a radial direction, that is, in the arrow direction B2 of FIG. 6. This effect may be provided because the waste toner actively flows due to the non-radial type wing portions 142-1 and 142-2.

Figure 12:
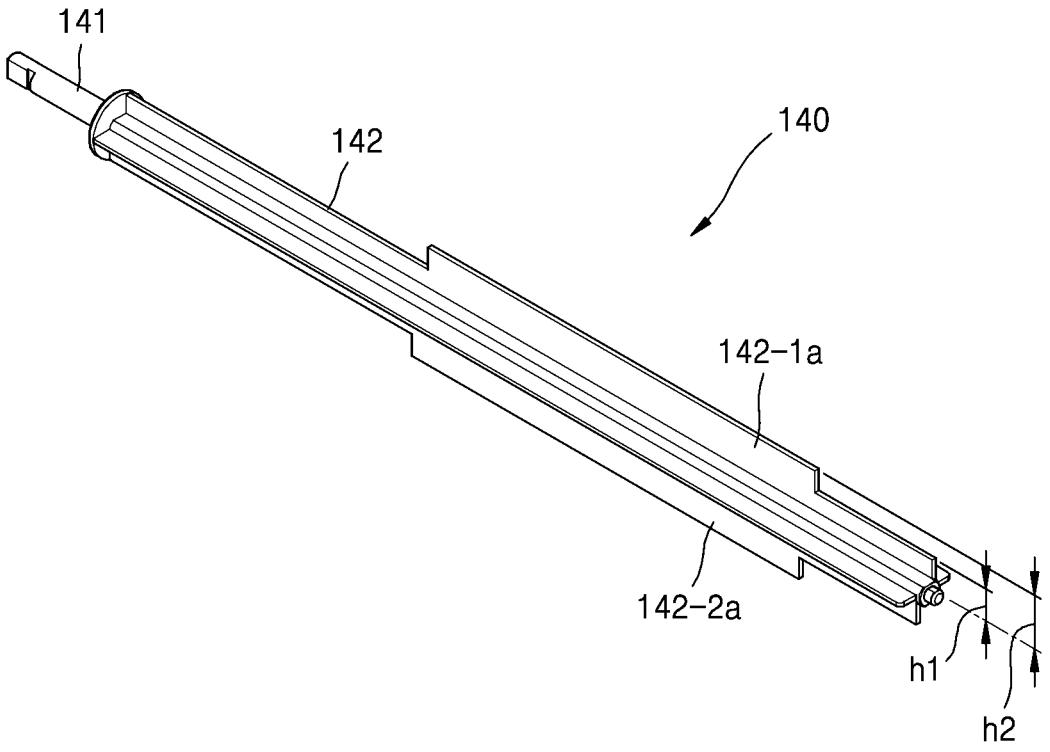
FIG. 12 is a perspective view of the second waste toner transporting member according to an embodiment.
Figure 13:
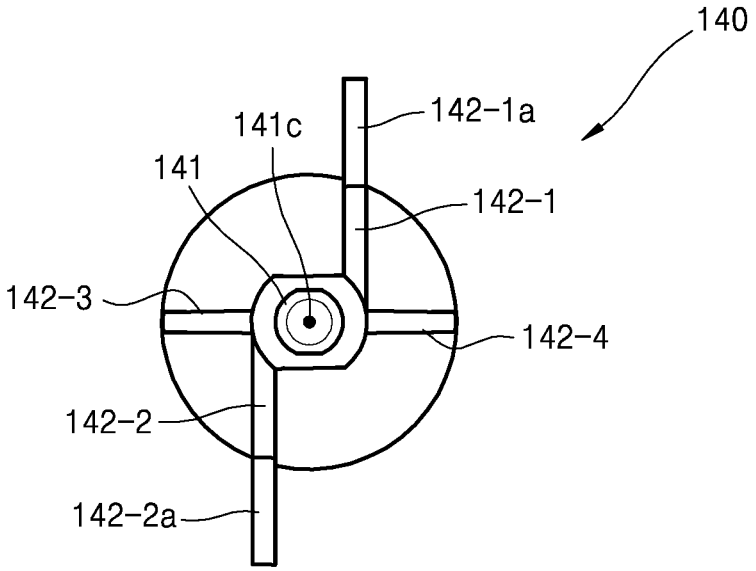
FIG. 13 is a side view of the second waste toner transporting member according to an embodiment.

FIG. 12 is a perspective view of the second waste toner transporting member 140 according to an embodiment. FIG. 13 is a side view of the second waste toner transporting member 140 illustrated, for example, in FIG. 12 according to an embodiment.

Referring to FIGS. 12 and 13, an external length of at least one of the plurality of wing portions 142, that is, a protrusion distance thereof from the rotational shaft 141, may not be uniform, for example, in an axial direction (length direction). That is, at least one of the plurality of wing portions 142 includes an extension portion extended to the outside. According to an embodiment, extension portions 142-1 a and 142-2*a* that extend externally are provided in a partial area of the non-radial type wing portions 142-1*a* and 142-2*a* in an axial direction. According to an embodiment, the waste toner that is transported in the length direction B1 by using the first waste toner transporting member 130 may be mainly accumulated in a center portion of the waster toner containing unit 120 since the waste toner does not accumulate near the waste toner inlet 121 due to the guide wall 123 and the waste toner may not be easily transported to the opposite side of the waste toner inlet 121. Accordingly, the extension portions 142-1*a* and 142-2*a* may be formed in a portion including a center portion of the wing portions 142 in an axial direction thereof, that is, in the length direction B1. Accordingly, the waste toner may be effectively dispersed into the waste toner containing unit 120. A protrusion distance h1 of two end portions of the non-radial type wing portions 142-1 and 142-2 may be smaller than a protrusion distance h2 of the center portion, thereby reducing a driving load caused by the waste toner. A large amount of waste toner may be relatively accumulated in a portion of the first waste toner transporting member 130 near the waste toner inlet 121, and thus, the extension portions 142-1*a* and 142-2*a* may also be deviated toward the waste toner inlet 121 from the center portion of the wing portions 142 in the length direction B1. Although not illustrated in the drawings, extension portions may also be formed in the radial type wing portions 142-3 and 142-4.

In a structure in which two second waste toner transporting member 140' having the radial type wing portions 142' illustrated in FIG. 10 are arranged, the waste toner may be accumulated mainly in the center portion of the waste toner containing unit 120. However, when the second waste toner transporting member 140 including the non-radial type wing portions 142-1 and 142-2 illustrated in FIGS. 8 and 9 is used, by using, for example, one second waste toner transporting member 140, concentration of the waste toner in the center portion of the waste toner containing unit 120 may be prevented and the waste toner may be uniformly dispersed over the entire area of the waste toner containing unit 120. When an extension portion is disposed in an area including the center portion of the waste toner containing unit 120, the waste toner may be dispersed more effectively.

By disposing the transportation wing 133 (see, for example, FIG. 7) at the end portion of the first waste toner transporting member 130, the waste toner that is moved toward the end portion of the first waste toner transporting member 130 by the second waste toner transporting member 140 may be carried to the second waste toner transporting member 140 again, thereby preventing accumulation of the waste toner at the end portion of the first waste toner transporting member 130.

According to an exemplary embodiment, use of a volume of the waste toner containing unit 120 may be maximized, and thus, the waste toner containing unit 120 may have a compact size and a long lifetime. By transporting the waste toner to the toner cartridge 100 and storing the same therein, a size of the waste toner accommodation space 44 of the imaging cartridge 400 may be reduced, and the imaging cartridge 400 may have a compact size. In addition, as the lifetime of the imaging cartridge 400 is not affected by an amount of the waste toner, the imaging cartridge 400 may have a long lifetime.

Figure 14:
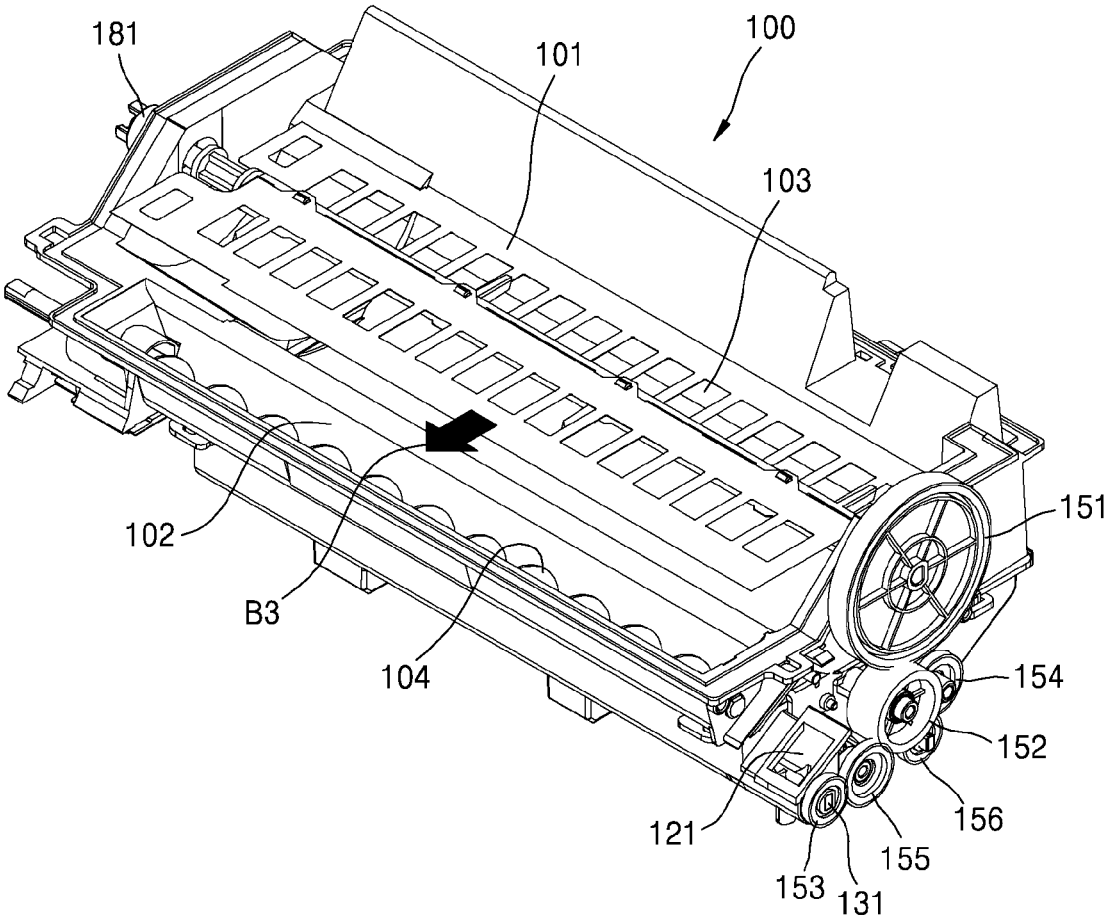
FIG. 14 is a perspective view of a driving structure that drives the first and second waste toner transporting members according to an embodiment.
Figure 15:
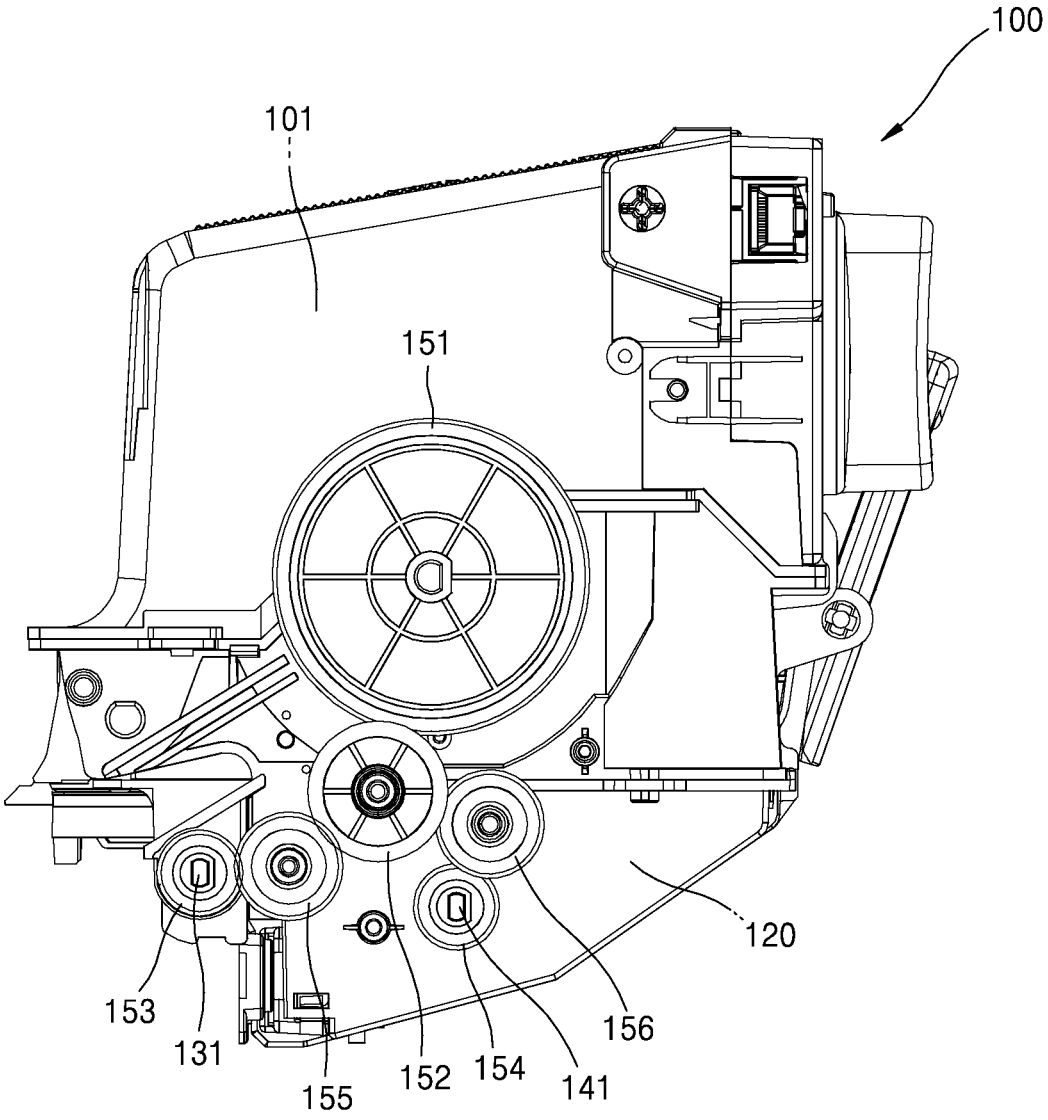
FIG. 15 is a side view of in exemplary driving structure.

FIG. 14 is a perspective view of a driving structure that drives the first and second waste toner transporting members 130 and 140 according to an embodiment. FIG. 15 is a side view of an exemplary driving structure.

Referring to FIGS. 14 and 15, a driving coupler 181 may be disposed at a side portion of the toner cartridge 100. The driving coupler 181 may be connected to a driving unit (not illustrated) provided in the main body 1 when the toner cartridge 100 is mounted in the main body 1. The driving coupler 181 may be connected to, for example, a first end portion of a rotational shaft of the first toner supply member 103. The first and second waste toner transporting members 130 and 140 receive a rotational force from the first toner supply member 103. A gear 151 may be disposed at a second end portion of the rotational shaft of the first toner supply member 103. The gear 151 may be engaged with a gear 152. Gears 153 and 154 are respectively coupled to the rotational shafts 131 and 141 of the first and second waste toner transporting members 130 and 140. The gears 153 and 154 may be engaged with the gear 152. In order to supply the toner in the toner containing unit 101 to the toner discharging unit 102, a waste toner transportation direction B3 of the first toner supply member 103 may be opposite to the direction B2 of the second waste toner transporting member 140 in which the waste toner is transported. That is, rotational directions of the first toner supply member 103 and the second waste toner transporting member 140 are opposite to each other. A gear 156 may be interposed between the gear 152 and the gear 154. For balancing purposes with respect to the rotational directions, rotational directions of the first toner supply member 103 and the first waste toner transporting member 130 may be set to be opposite. A gear 155 may be interposed between the gear 152 and the gear 153.

While one second waste toner transporting member 140 may be disposed in the waste toner containing unit 120 in the above-described embodiments, the embodiments of the present invention are not limited thereto. According to an embodiment, two or more second waste toner transporting members 140 that are spaced apart in the width direction B2 may be disposed.

Figure 16:
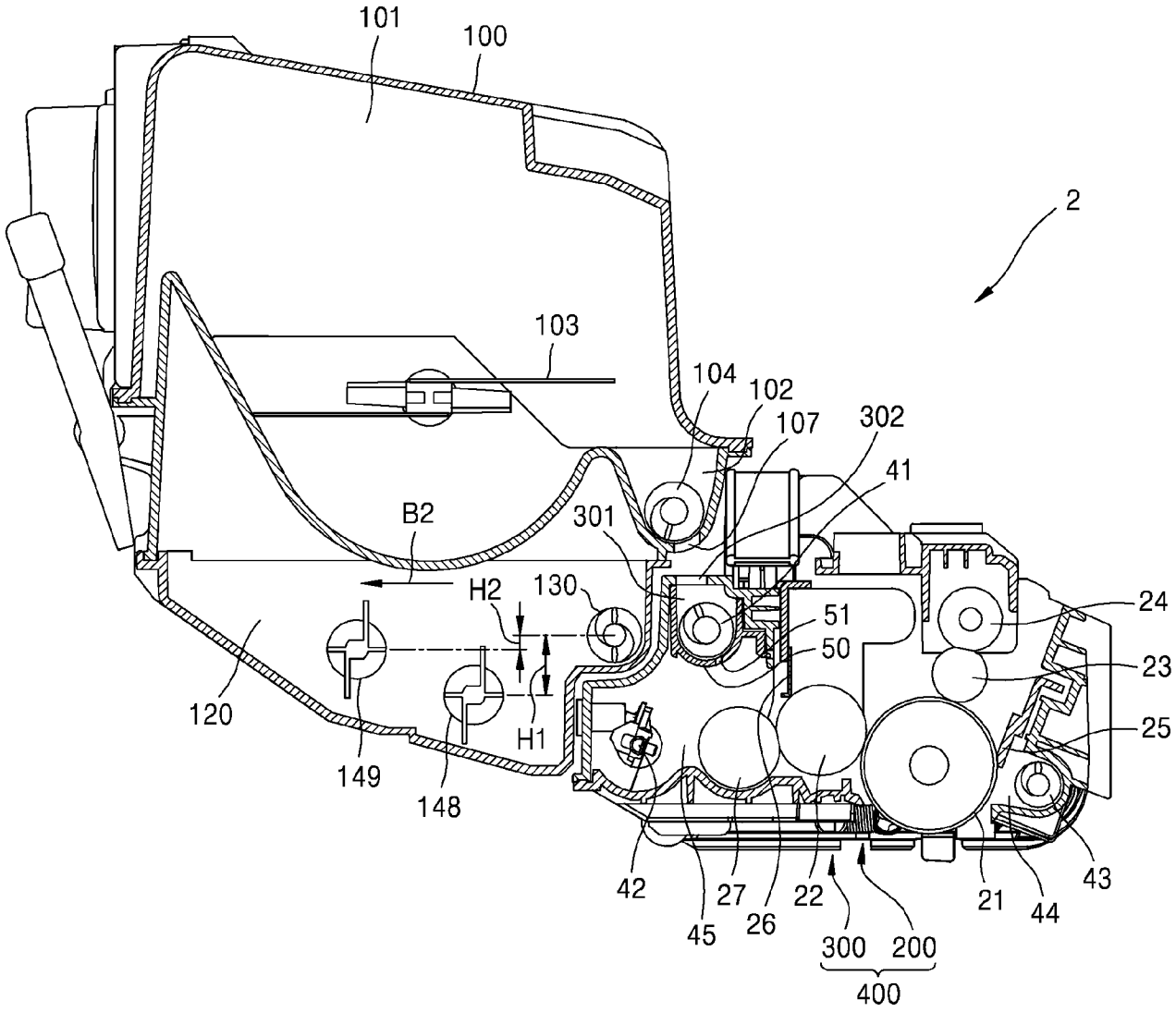
FIG. 16 is a schematic structural diagram of a process cartridge including two second waste toner transporting members disposed in a waste toner containing unit, according to an embodiment.

FIG. 16 is a schematic structural diagram of the process cartridge 2 according to an embodiment. Referring to FIG. 16, two second waste toner transporting members 148 and 149 may be disposed in the waste toner containing unit 120. The second waste toner transporting members 148 and 149 may be spaced apart from each other in the width direction B2. The shape of the second waste toner transporting members 148 and 149 may be the same as that of the second waste toner transporting member 140 illustrated in FIGS. 8 and 9 or the second waste toner transporting member 140 illustrated in FIGS. 12 and 13. Rotational centers of the second waste toner transporting members 148 and 149 may be lower than that of the first waste toner transporting member 130. That is, the second waste toner transporting members 148 and 149 may be located further below than the first waste toner transporting member 130 so that height differences H1 and H2 may be formed between the rotational centers of the second waste toner transporting members 148 and 149 and the rotational center of the first waste toner transporting member 130. The height differences H1 and H2 may be the equal to, or different from, each other. According to an embodiment, the waste toner that is transported from the first waste toner transporting member 130 in the width direction B2 may be further effectively carried in the width direction B2 so as to disperse the waste toner into the waste toner containing unit 120. Three or more second waste toner transporting members may be used.

Figure 17:
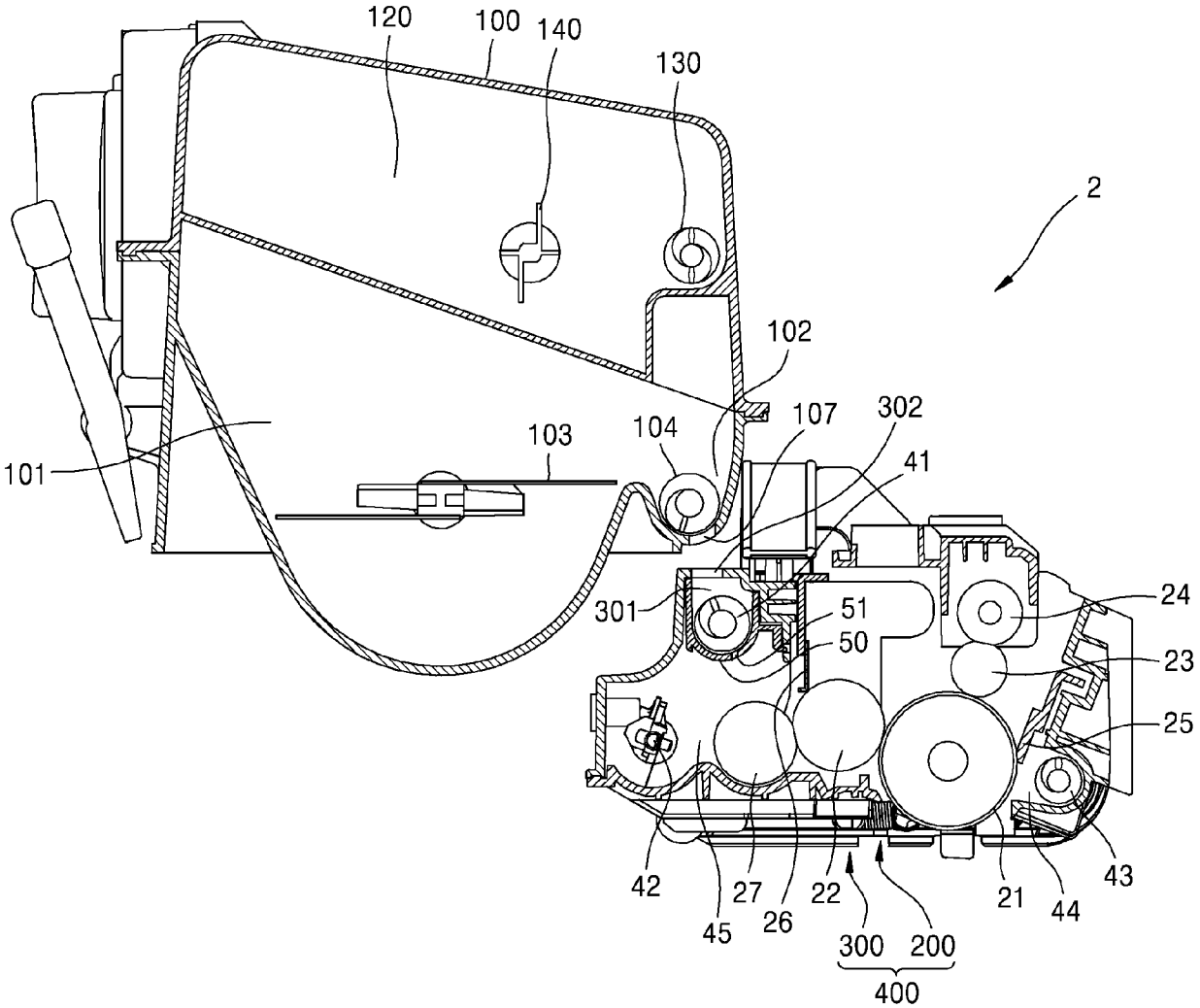
FIG. 17 is a schematic structural diagram of a process cartridge including a waste toner containing unit disposed above a toner containing unit, according to an embodiment.

Although the waste toner containing unit 120 is described as being located below the toner containing unit 101 in a gravitational direction in the above-described embodiments, the embodiments of the present invention are not limited thereto. FIG. 17 is a schematic structural diagram of the process cartridge 2 according to an embodiment. Referring to FIG. 17, the waste toner containing unit 120 may be disposed above the toner containing unit 101 in a gravitational direction. Although not illustrated in the drawing, the waste toner transporting unit 60 upwardly extends from the waste toner accommodation space 44 to be connected to the waste toner containing unit 120.

Figure 18:
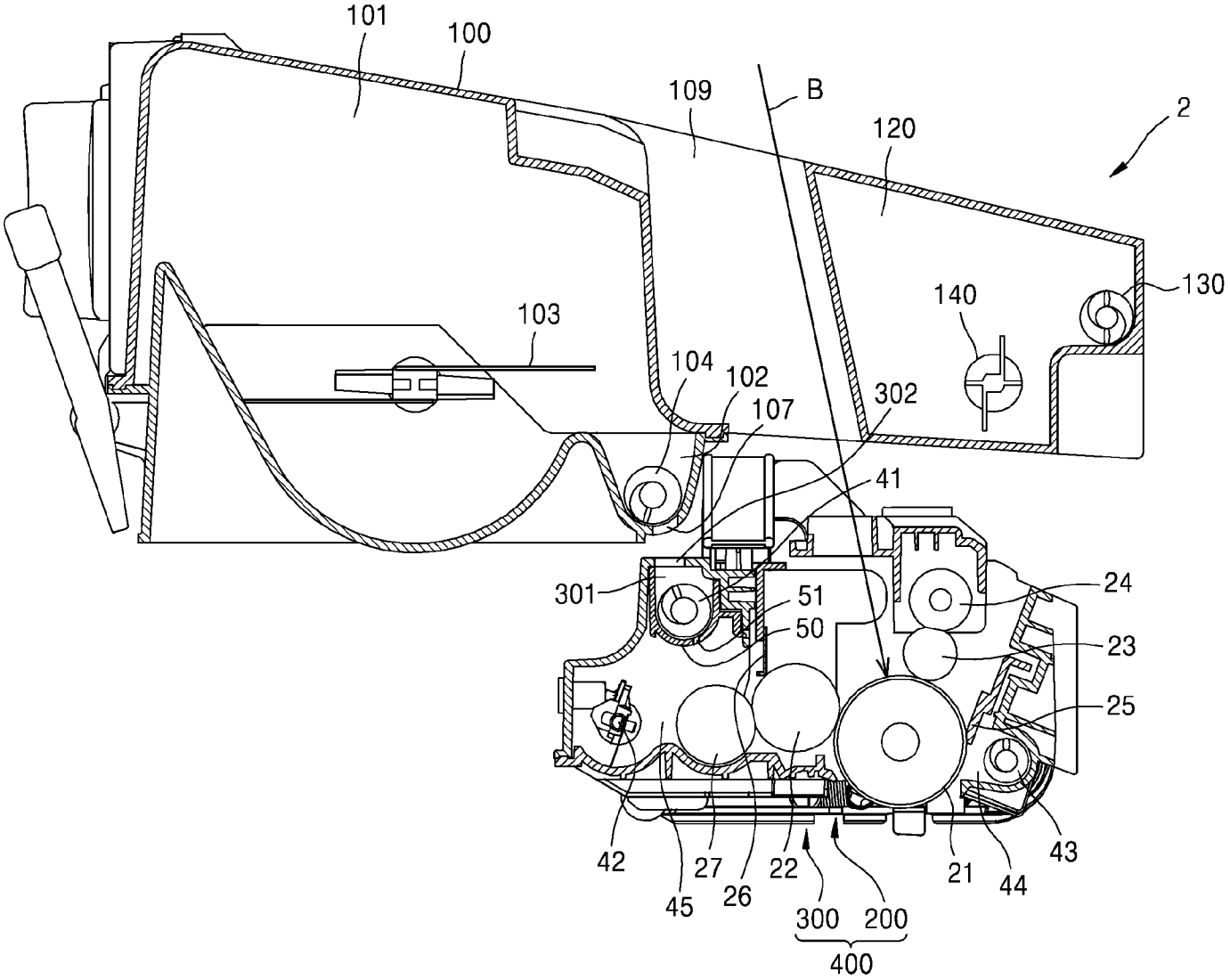
FIG. 18 is a schematic structural diagram of a process cartridge including a waste toner containing unit disposed at a side portion of a toner containing unit, according to an embodiment.

FIG. 18 is a schematic structural diagram of the process cartridge 2 according to an embodiment. Referring to FIG. 18, the waste toner containing unit 120 may be disposed at a side portion of the toner containing unit 101, that is, above the development unit 300. Although not illustrated in the drawing, the waste toner transporting unit 60 upwardly extends from the waste toner accommodation space 44 to be connected to the waste toner containing unit 120. A light path 109 may be provided between the toner containing unit 101 and the waste toner containing unit 120 so that the light B that reaches the photoconductive drum 21 passes through.

Although the process cartridge 2 having the first structure is described in the above-described embodiments, the embodiments of the present invention are not limited thereto. The process cartridge 2 may also have the second, third, or fourth structure.

Figure 19:
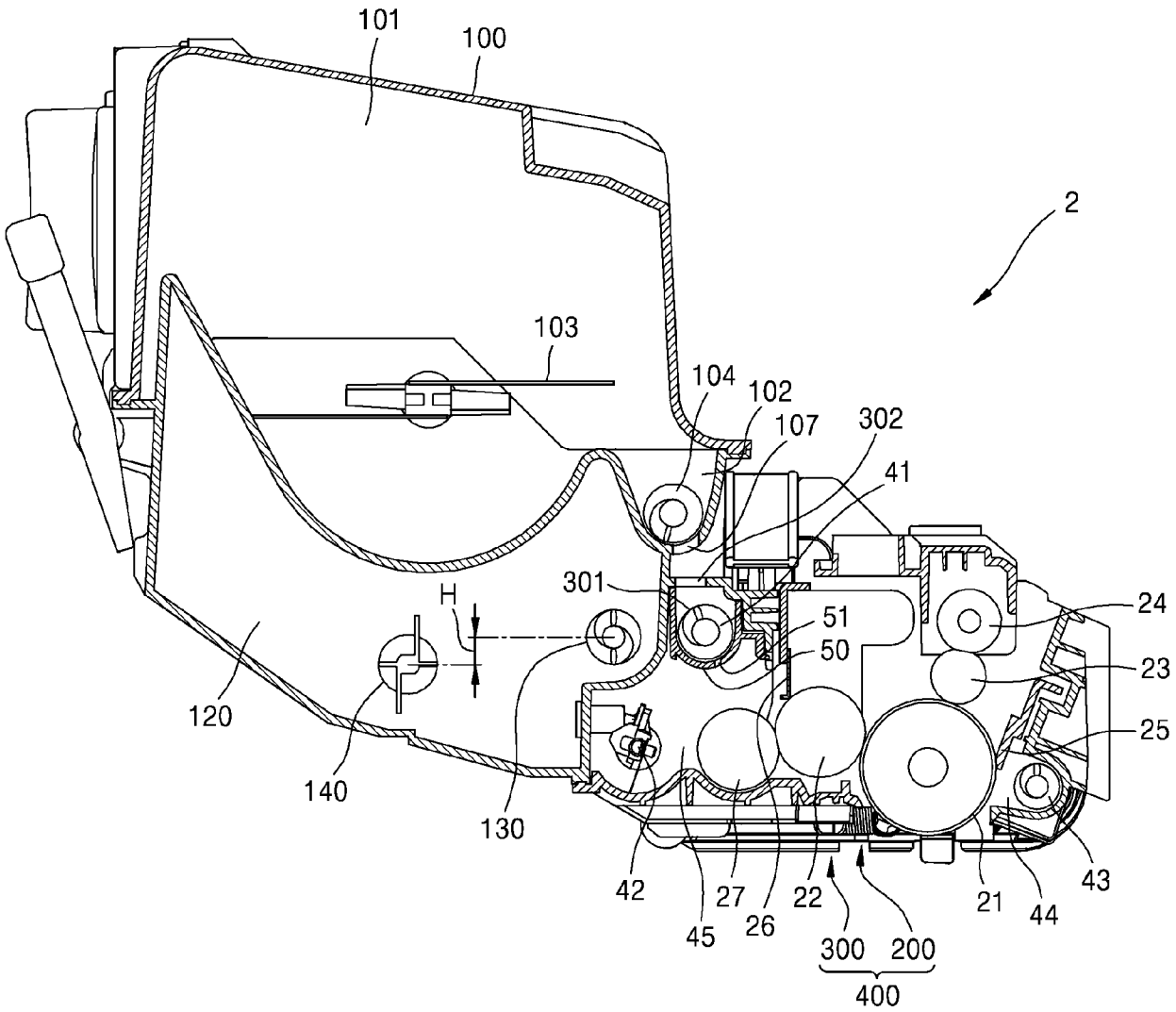
FIG. 19 is a schematic structural diagram of a process cartridge including a toner cartridge integrally formed with a developing unit, according to an embodiment.

FIG. 19 is a schematic structural diagram of the process cartridge 2 according to an embodiment. Referring to FIG. 19, the toner cartridge 100 may be integrally formed with the development unit 300. If a development cartridge including the toner cartridge 100 and the developing unit 300 that are integrally formed is disposed such that the development nip N or the development gap g with respect to the photoreceptor cartridge 200 is maintained, the process cartridge 2 having the third structure may be used. In FIG. 19, even when the development unit 300 and the photoreceptor unit 200 are integrally formed, the process cartridge 2 having the fourth structure may be used.

It should be understood that the exemplary embodiments described therein should be considered in a descriptive sense only and not for purposes of limitation. Descriptions of features or aspects within each embodiment should typically be considered as available for other similar features or aspects in other embodiments.

While one or more embodiments of the present invention have been described with reference to the figures, it will be understood by those of ordinary skill in the art that various changes in form and details may be made therein without departing from the spirit and scope of the present invention as defined by the following claims.

What is claimed is:

1. A toner cartridge that is attachable to, or detachable from, a main body of an image forming apparatus, the toner cartridge comprising:

a toner containing unit;

a waste toner containing unit that is disposed below the toner containing unit in a gravitational direction and comprises a waste toner inlet through which waste toner flows, the waste toner containing unit including:

a first waste toner transporting member that transports the waste toner from the waste toner inlet in a length direction of the waste toner containing unit, and a second waste toner transporting member that transports the waste toner that is transported in the length direction by the first waste toner transporting member in a width direction of the waste toner containing unit, wherein a rotational center of the second waste toner transporting member is lower than a rotational center of the first waste toner transporting member.

2. The toner cartridge of claim 1, wherein the second waste toner transporting member comprises a rotational shaft that extends in the length direction and a plurality of wing portions that externally extend from the rotational shaft, and wherein the plurality of wing portions comprise a non-radial type wing portion that is eccentric with respect to a center of the rotational shaft.

3. The toner cartridge of claim 2, wherein the plurality of wing portions further comprise a radial type wing portion that radially extends from a center of the rotational shaft.

4. The toner cartridge of claim 3, wherein the non-radial type wing portion and the radial type wing portion are alternately arranged.

5. The toner cartridge of claim 2, wherein at least one of the plurality of wing portions comprises an extension portion that externally protrudes from a portion of the wing portions in the length direction.

6. The toner cartridge of claim 5, wherein the extension portion is formed in a center portion of the wing portions in the length direction.

7. The toner cartridge of claim 5, wherein the extension portion is slanted toward the waste toner inlet in the length direction.

8. The toner cartridge of claim 5, wherein the extension portion is formed in the non-radial type wing portions.

9. The toner cartridge of claim 1, wherein the waste toner inlet is located at a side portion of the waste toner containing unit in the length direction.

10. The toner cartridge of claim 9, wherein the first waste toner transporting member comprises a rotational shaft extending in the length direction and a spiral wing formed along the rotational shaft, and wherein a guide wall is provided near a side wall of the waste toner containing unit to be close to the waste toner inlet, the guide wall blocking the waste toner that is transported by using the first waste toner transporting member in the length direction from being transported in the width direction of the waste toner containing unit.

11. The toner cartridge of claim 10, wherein the guide wall extends from the side wall in the length direction.

12. The toner cartridge of claim 10, wherein an end portion of the first waste toner transporting member opposite to the waste toner inlet does not include a spiral wing.

13. The toner cartridge of claim 12, wherein a transportation wing that radially extends from the rotational shaft of the first waste toner transporting member and transports the waste toner in the width direction is provided in a portion where the spiral wing is not included.

14. The toner cartridge of claim 1, further comprising:

a toner discharging unit including a toner outlet through which toner is discharged from the toner containing unit; and a first toner supply member that supplies the toner from the toner containing unit to the toner discharging unit, wherein the first and second waste toner transporting members are driven in connection with the first toner supply member.

15. The toner cartridge of claim 14, wherein a driving coupler that is connected to a driving unit of the main body when the toner cartridge is mounted in the main body is mounted at an end portion of the rotational shaft of the first toner supply member.

16. The toner cartridge of claim 14, wherein the first toner supply member and the second waste toner transporting member rotate in opposite directions to each other.

17. The toner cartridge of claim 1, wherein a plurality of second waste toner transporting members are arranged in the width direction of the waste toner containing unit.

18. A toner cartridge that is attachable to, or detachable from, a main body of an image forming apparatus, the toner cartridge comprising:

a toner containing;

a waste toner containing unit that is disposed below the toner containing the unit in a gravitational direction and comprises, at a side portion in a length direction thereof, a waste toner inlet through which waste toner flows including:

a first waste toner transporting member to disperse waste toner in a length direction of the waste toner containing unit, and comprises a rotational shaft that extends in the length direction of the waste toner containing unit, and a second waste toner transporting member to disperse the waste toner that is transported in the length direction by the first waste toner transporting member in a width direction of the waste containing unit and comprises a plurality of wing portions that externally extend from the rotational shaft, wherein the plurality of wing portions comprise a non-radial type wing portion that is eccentric with respect to a center of the rotational shaft.

19. The toner cartridge of claim 18, wherein the plurality of wing portions further comprise a radial type wing portion that radially extends from the center of the rotational shaft.

20. The toner cartridge of claim 19, wherein the non-radial type wing portion and the radial wing portion are alternately arranged.

21. The toner cartridge of claim 18, wherein at least one of the plurality of wing portions comprises an extension portion that externally protrudes from a portion of the wing portions in the length direction.

22. The toner cartridge of claim 21, wherein the extension portion is formed in a center portion of the wing portions in the length direction.

23. The toner cartridge of claim 21, wherein the extension portion is slanted toward the waste toner inlet in the length direction.

24. The toner cartridge of claim 21, wherein the extension portion is formed in the non-radial type wing portion.

25. An electrophotographic image forming apparatus comprising:

a main body; and the toner cartridge of claim 1.

26. The electrophotographic image forming apparatus of claim 25, further comprising an imaging cartridge that is attachable to, or detachable from, the main body and comprises a photoreceptor on which an electrostatic latent image is formed and a developing roller that supplies toner supplied from the toner cartridge to the photoreceptor to develop the electrostatic latent image.

27. The electrophotographic image forming apparatus of claim 26, further comprising a waste toner transporting unit that transports the waste toner removed from the photoreceptor to the waste toner containing unit.

28. The electrophotographic image forming apparatus of claim 26, wherein the toner cartridge is integrally formed with the imaging cartridge.

29. An electrophotographic image forming apparatus comprising:

a main body; and the toner cartridge of claim 18.

30. The electrophotographic image forming apparatus of claim 29, further comprising an imaging cartridge that is attachable to or detachable from the main body and comprises a photoreceptor on which an electrostatic latent image is formed and a developing roller that supplies toner supplied from the toner cartridge to the photoreceptor to develop the electrostatic latent image.

31. The electrophotographic image forming apparatus of claim 30, further comprising a waste toner transporting unit that transports waste toner removed from the photoreceptor to the waste toner containing unit.

32. The electrophotographic image forming apparatus of claim 30, wherein the toner cartridge is integrally formed with the imaging cartridge.

* * * * *